US008567604B2

(12) United States Patent
Overgaad

(10) Patent No.: US 8,567,604 B2
(45) Date of Patent: Oct. 29, 2013

(54) CONTAINER FOR PRODUCE STORAGE, PACKING AND TRANSPORT

(75) Inventor: Peter Overgaad, Carpinteria, CA (US)

(73) Assignee: Green Growth Consulting, LLC, Carpinteria, CA (US)

( * ) Notice: Subject to any disclaimer, the term of this patent is extended or adjusted under 35 U.S.C. 154(b) by 53 days.

(21) Appl. No.: 13/239,851

(22) Filed: Sep. 22, 2011

(65) Prior Publication Data

US 2012/0006842 A1 Jan. 12, 2012

Related U.S. Application Data

(63) Continuation-in-part of application No. 12/853,208, filed on Aug. 9, 2010, now abandoned.

(60) Provisional application No. 61/232,227, filed on Aug. 7, 2009.

(51) Int. Cl.
*B65D 21/032* (2006.01)
*B65D 21/036* (2006.01)
*B65D 21/02* (2006.01)

(52) U.S. Cl.
CPC ..... *B65D 21/0222* (2013.01); *B65D 21/0217* (2013.01)
USPC ..... 206/509; 220/380; 220/4.26; 220/810; 220/669; 220/608; 206/508

(58) Field of Classification Search
USPC ..... 220/380, 406, 4.26, 23.6, 519, 781, 220/810, 669, 608; 206/503, 499, 501, 504, 206/508, 821
See application file for complete search history.

(56) References Cited

U.S. PATENT DOCUMENTS

| | | | | |
|---|---|---|---|---|
| 4,576,330 | A * | 3/1986 | Schepp | 220/315 |
| 6,886,694 | B2 * | 5/2005 | McNeeley et al. | 206/505 |
| 7,287,660 | B2 * | 10/2007 | Ramirez et al. | 220/4.23 |
| 8,083,084 | B2 * | 12/2011 | Vovan | 220/4.24 |
| 2005/0205570 | A1 * | 9/2005 | Ramirez et al. | 220/4.21 |
| 2007/0114231 | A1 * | 5/2007 | Blythe et al. | 220/4.21 |

* cited by examiner

*Primary Examiner* — Robert J Hicks
*Assistant Examiner* — Kareen Rush
(74) *Attorney, Agent, or Firm* — Heidi L. Eisenhut; Loza & Loza, LLP

(57) ABSTRACT

Embodiments are directed to containers for storage and transportation of items such as produce harvested with its roots intact. The containers include a base and lid hingedly connected together on at least one edge, and may be stacked to maximize density for storage so that a shipping receptacle can hold more produce while taking up the same place, allowing for more efficient transportation saving on transportation costs and storage. In addition to saving costs on transportation and storage, the containers maintain the freshness of the produce harvested with its roots intact by keeping away soil, soil debris and moisture from the remaining portions of the produce. When containers are stacked together, a substantially circular recessed center portion on a top surface of the lid of a first container is adapted to receive a substantially circular male protruding center portion one the base of a second, identical container.

20 Claims, 21 Drawing Sheets

CONTAINER FOR PRODUCE STORAGE, PACKING AND TRANSPORT

CLAIM OF PRIORITY UNDER 35 U.S.C. §119

This non-provisional United States (U.S.) Patent Application is a continuation-in-part application of, and claims priority on, non-provisional U.S. patent application Ser. No. 12/853,208 entitled "Container for Produce Storage, Packing & Transport", filed on Aug. 9, 2010, the contents of which is hereby incorporated by reference, which claims priority to U.S. Provisional Application No. 61/232,227 entitled "Container For Produce Storage, Packing & Transport", filed Aug. 7, 2009, and hereby expressly incorporated by reference herein.

FIELD

The present invention relates to the field of containers, in particular, to stackable or nestable containers for storage and transportation of items such as produce harvested with its roots intact.

BACKGROUND OF THE INVENTION

It is well known to use produce containers to store and transport fresh and chilled foods, such as lettuce, for selling to consumers. The containers allow the food to be transported with less damage and provide convenient packaging for consumers who are purchasing the food. However, conventional containers are not securely stackable and do not fit efficiently on or within the shipping receptacle. As a result, more shipping receptacles are needed to transport the containers which increases both transportation and storage costs.

In addition to not being securely stackable and not fitting efficiently on or within a shipping receptacle, conventional produce containers do not provide for easily packaging and storing produce harvested with its roots intact. When using conventional containers for storing and transporting produce harvested with its roots intact, soil, soil debris and moisture comes in contact with the product reducing the freshness of the food packed.

Consequently, containers which alleviate the problems of conventional containers as discussed above are needed. In other words, what is needed are containers that can be stacked to maximize density for storage so that a shipping receptacle can hold more content while taking up the same place allowing for more efficient transportation saving on transportation costs and storage. Furthermore, containers maintain the freshness of produce harvested with its roots intact by keeping away soil, soil debris and moisture from the remaining portions of the produce is needed.

SUMMARY

The following presents a simplified summary of one or more embodiments in order to provide a basic understanding of some embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

According to one embodiment, a stackable or nestable container for storage and transportation of items such as produce harvested with its roots intact is provided. The container may comprise a base having a bottom, a pair of lower sidewalls, and a pair of lower end walls; the bottom, the pair of lower sidewalls and the pair of lower end walls being integrally connected, wherein the bottom includes a lower portion positioned below, and parallel to, an upper portion creating a center opening in an outer side surface of the bottom; and a lid having a top, a pair of upper sidewalls, and a pair of upper end walls, the bottom, the pair of upper sidewalls and the pair of upper end walls being integrally connected, wherein the top has a pair of upwardly sloping surfaces and a pair of a pair of downwardly sloping surfaces that extend along a first outer portion of the top parallel to the upper sidewalls and a second outer portion of the top parallel to the upper end walls, and wherein the pair of upwardly sloping surfaces and the pair of downwardly sloping surfaces are received within an identical container base stacked on top of the lid.

The base may further comprises a wall member integrally formed with, and separating the lower portion and the upper portion creating a retaining ring in an inner side surface of the base. The wall member may include an inner sidewall and an outer sidewall joined together at uppermost edges by a flat planar top portion. The outer sidewall diverges outwardly from the flat planar top portion to the lower portion of the bottom of the base and the inner sidewall diverges outwardly from the flat planar top portion to the upper portion of the bottom of the base. Additionally, the inner sidewall and the outer sidewall may include a plurality of concave grooves separated by a plurality of radially projecting protrusions. The plurality of concave grooves and the plurality of radially projecting protrusions are integrally connected together in a circular fashion equidistant from an outer circumference of a circular protruding surface portion located in the center of the upper portion of the bottom of the base.

The container may further comprise a lower flange integrally connect to, and outwardly projecting from, a perimeter of the pair of lower sidewalls and the pair of lower end walls; and an upper flange integrally connect to, and outwardly projecting from, a perimeter of the pair of upper sidewalls and the pair of upper end walls. A female recess located within the lower flange and dimensioned to receive a male rib located within the upper flange for securing the lid to the base.

According another embodiment, a stackable or nestable container for storage and transportation of items such as produce harvested with its roots intact is provided. The container may comprise a base having a continuous body portion and a lower rim encompassing and projecting laterally outwardly from the continuous body portion. The continuous body portion may comprise a circular bottom portion comprising an outer portion surrounding a flat center portion, the outer portion comprises a plurality of longitudinal concave grooves having a first end and a second end, the first end separated by a plurality of protrusions projecting inwardly into the base; a front surface portion extending downwardly from the lower rim and integrally connected to the bottom portion; and a lower having a continuous sidewall encompassing and projecting upwardly and outwardly from the bottom portion, the continuous sidewall having a back surface portion opposite and parallel to the front surface portion and extending downwardly from the lower rim; and a lid, hingedly connected to the base.

The lid may comprise a top surface; a pair of upper sidewalls; a pair of upper end walls integrally connected to the top surface and the upper sidewalls, wherein an edge of the pair of upper sidewalls and the at least one upper end wall extend outwardly to form an upper rim; and a plurality of longitudinal top depressions located on the top surface of the lid projecting outwardly in a circular pattern from an inner portion of the top surface, wherein the plurality of longitudinal top depressions of a bottom container is adapted to receive the plurality of longitudinal concave grooves of a top container when the top container is stacked on top of the bottom container.

The pair of upper sidewalls and the pair of upper end walls of the lid may be integrally connected via a pair of upper front depressions and a pair of upper back depressions and a longitudinal upper center depression may be located in each of the pair of upper sidewalls between an upper front depression of the pair of upper front depressions and an upper back depression of the pair of upper back depressions. The longitudinal upper center depression, located in the each of the pair of upper sidewalls, diverge inwardly coming to a rounded point at approximately the top surface of the lid. Furthermore, the continuous body portion of the base, between the front surface portion and the back surface portion, may include a plurality of upper base depressions extending downwardly from the lower rim and spaced equal distances apart.

The plurality of upper base depressions may have a rounded bottom end and sides that diverge outward up to the lower rim so that when the lid is engaged with the base, the longitudinal upper center depression located in the each of the pair of upper sidewalls, the pair of upper front depressions and the pair of upper back depressions are in alignment with the plurality of upper base depressions forming a teardrop shape.

According yet another embodiment, a stackable or nestable container for storage and transportation of items such as produce harvested with its roots intact is provided. The container may comprise a base having a continuous body portion and a lower rim encompassing and projecting laterally outwardly from the continuous body portion and a lid, hingedly connected to the base. The continuous body portion includes a circular bottom portion having a substantially circular male protruding center portion projecting outwardly from the base; a front surface portion extending downwardly from the lower rim and integrally connected to the circular bottom portion; a lower body portion having a continuous sidewall encompassing and projecting upwardly and outwardly from the circular bottom portion, the continuous sidewall having a back surface portion opposite and parallel to the front surface portion and extending downwardly from the lower rim. The substantially circular male protruding center portion may include a lower surface positioned below, and parallel to, and an upper surface of the circular bottom portion is circular.

The lid may include a top surface having a substantially circular recessed center portion projecting inwardly into the base, the substantially circular recessed center portion dimensioned to receive the substantially circular male protruding center portion of an identical container base stacked on top of the lid; a pair of upper sidewalls; and a pair of upper end walls integrally connected to the top surface and the pair of upper sidewalls; and wherein an edge of the pair of upper sidewalls and the at least one upper end wall extend outwardly to form an upper rim.

The continuous body portion of the base may include a plurality of longitudinal concave grooves having a first end and a second end, the first end separated by a plurality of protrusions projecting inwardly into the base and the lid may further include a plurality of longitudinal top depressions located on the top surface of the lid projecting outwardly in a circular pattern from an outer edge of the substantially circular recessed center portion. The plurality of longitudinal top depressions of a bottom container is adapted to receive the plurality of longitudinal concave grooves of a top container when the top container is stacked on top of the bottom container. The plurality of longitudinal concave grooves and the plurality of protrusions are integrally connected together in a circular fashion, wherein each of the plurality of longitudinal concave grooves on the base is formed at an outer edge of the substantially circular male protruding center portion and project laterally outward at least partially up the continuous sidewall and wherein the second end of the plurality of longitudinal concave grooves are separated by a plurality of lower depressions.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, certain terminology is used to describe certain features of one or more embodiments of the invention. The term "container" refers to any type of device for holding objects, including a receptacle, a bin, a box, a carton, a case, and a crate. The term "food" refers to any type of edible substance including all types of fruits, vegetables and bakery goods.

Figure 1:
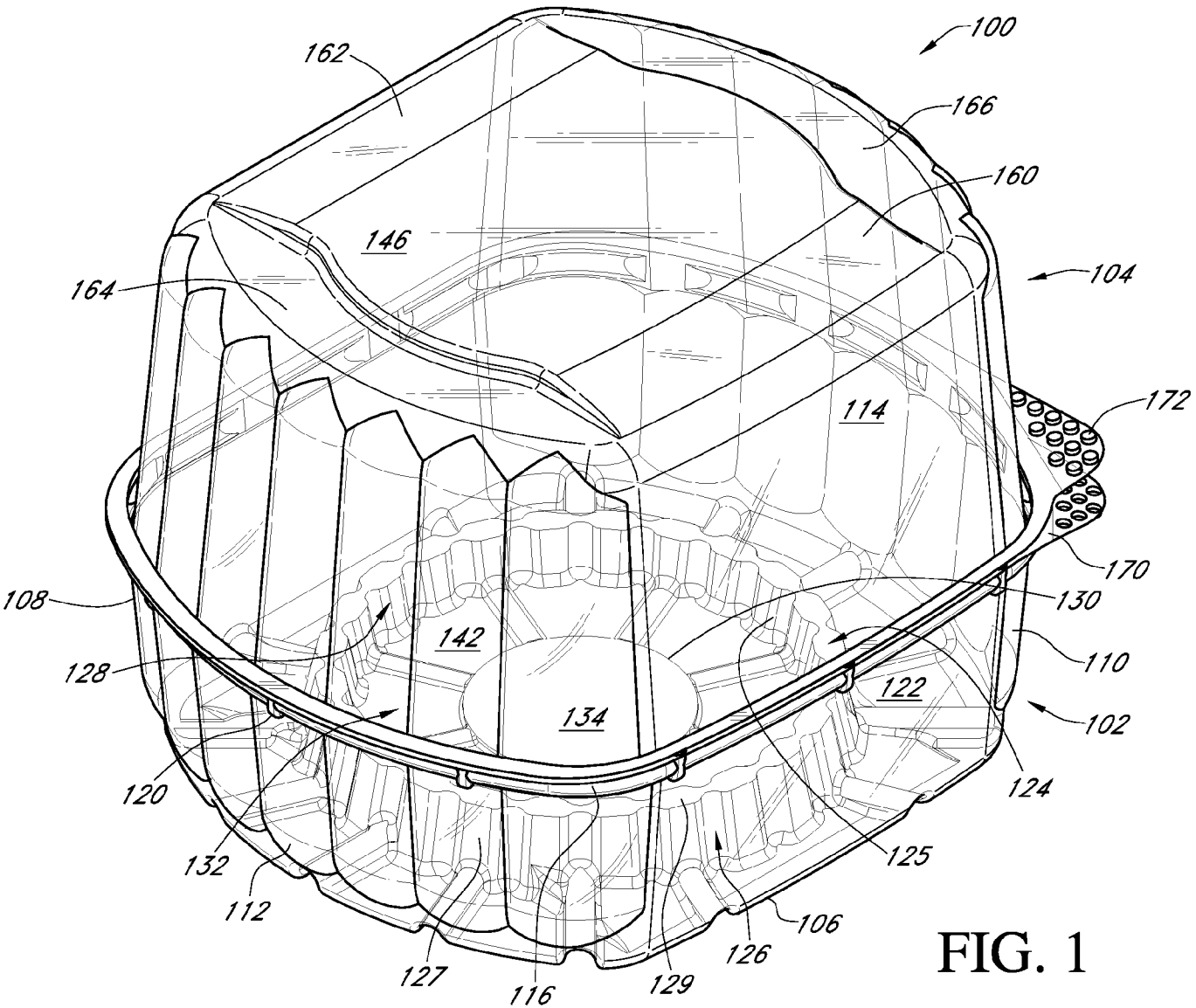
FIG. 1 illustrates a top perspective view of a container of the present invention in a closed configuration, according to one embodiment.
Figure 2:
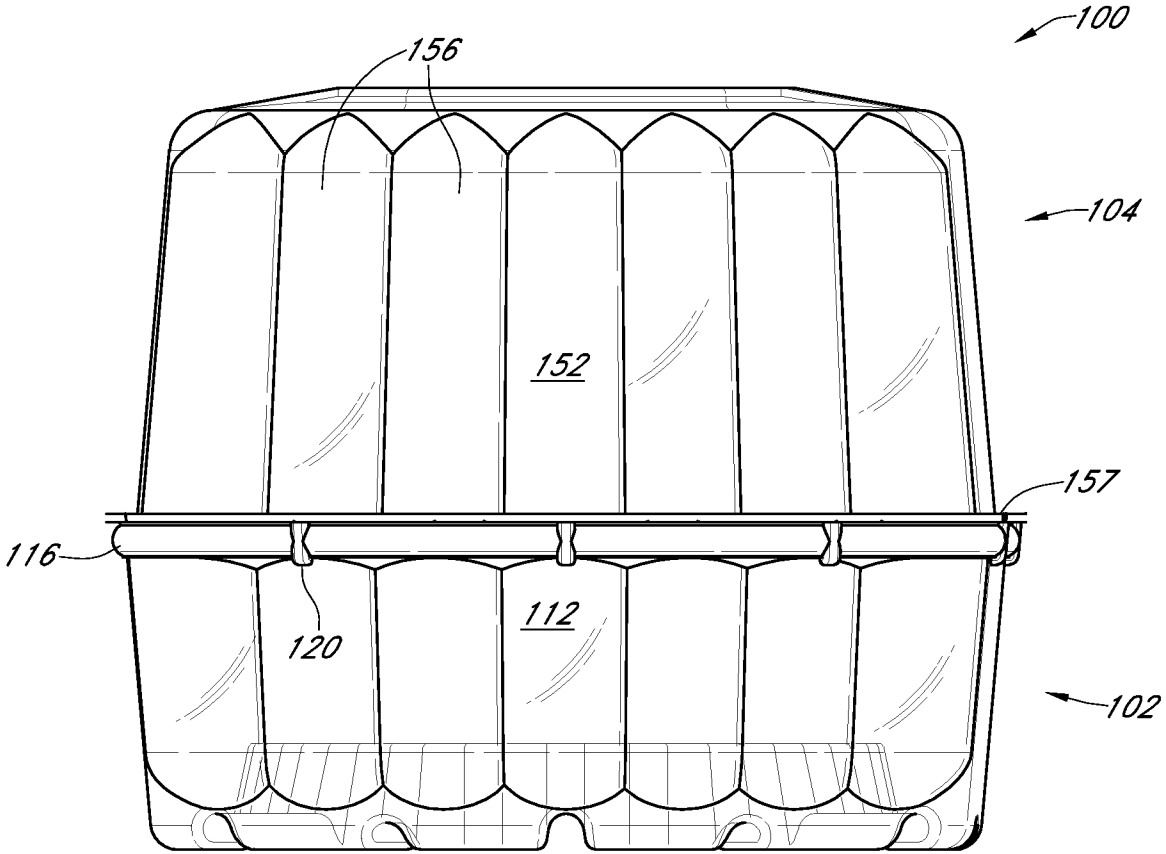
FIG. 2 illustrates a right side elevational view of the container of FIG. 1 in a closed configuration.
Figure 3:
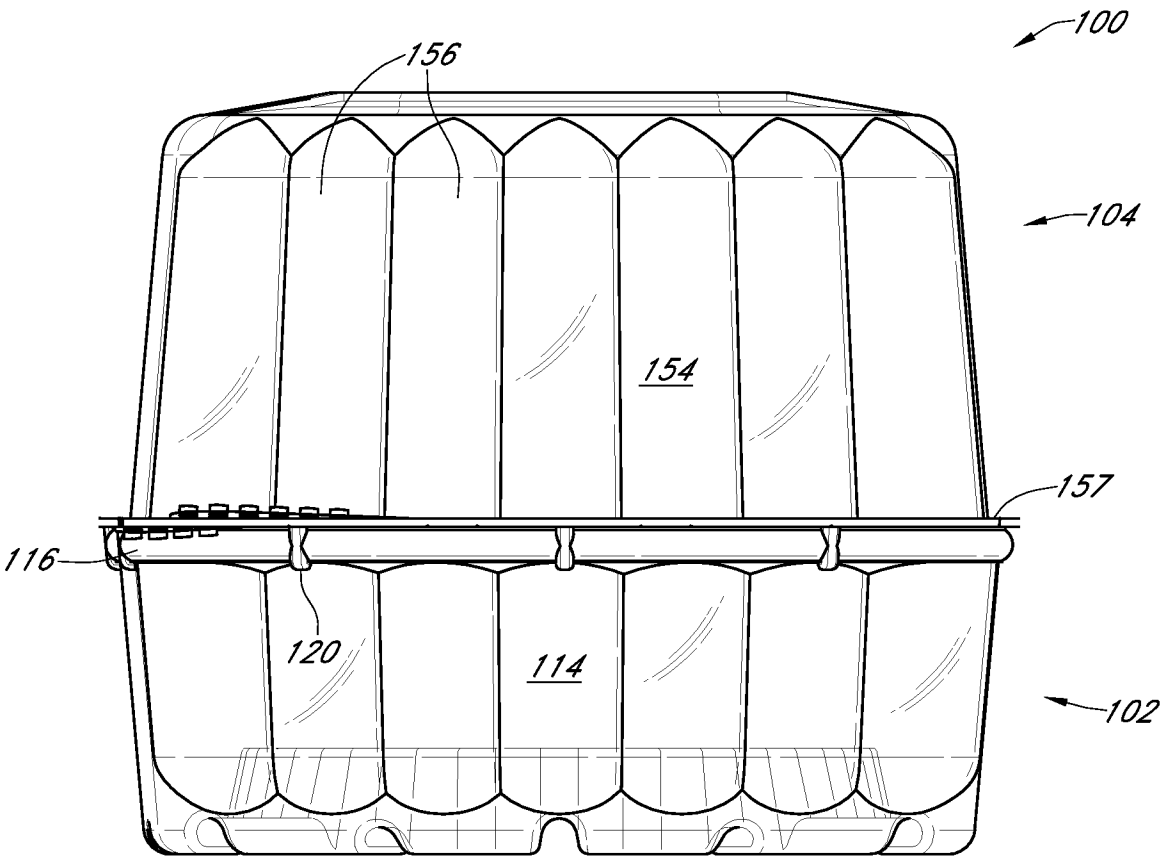
FIG. 3 illustrates a left side elevational view of the container of FIG. 1 in a closed configuration.
Figure 4:
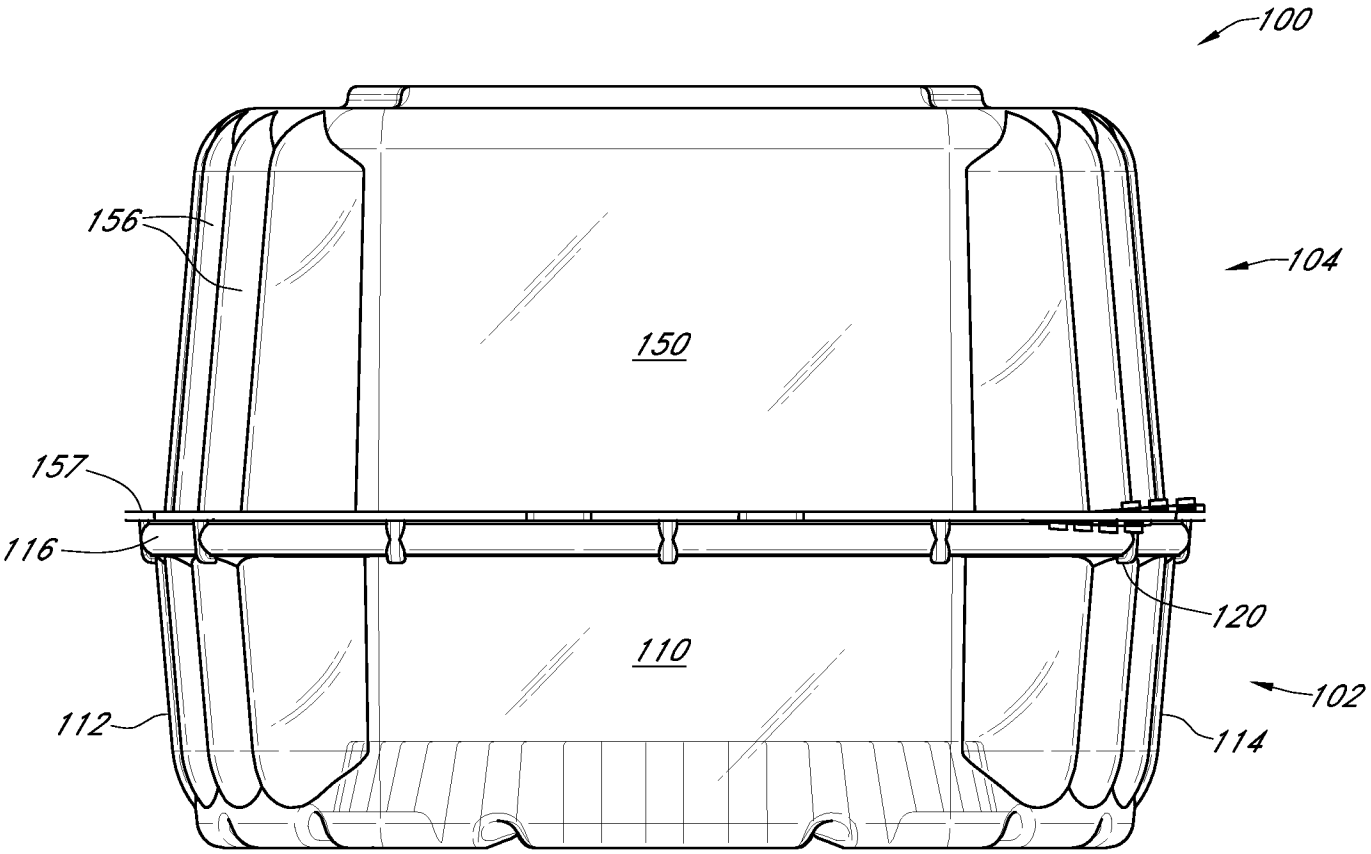
FIG. 4 illustrates a front elevational view of the container of FIG. 1 in a closed configuration.
Figure 5:
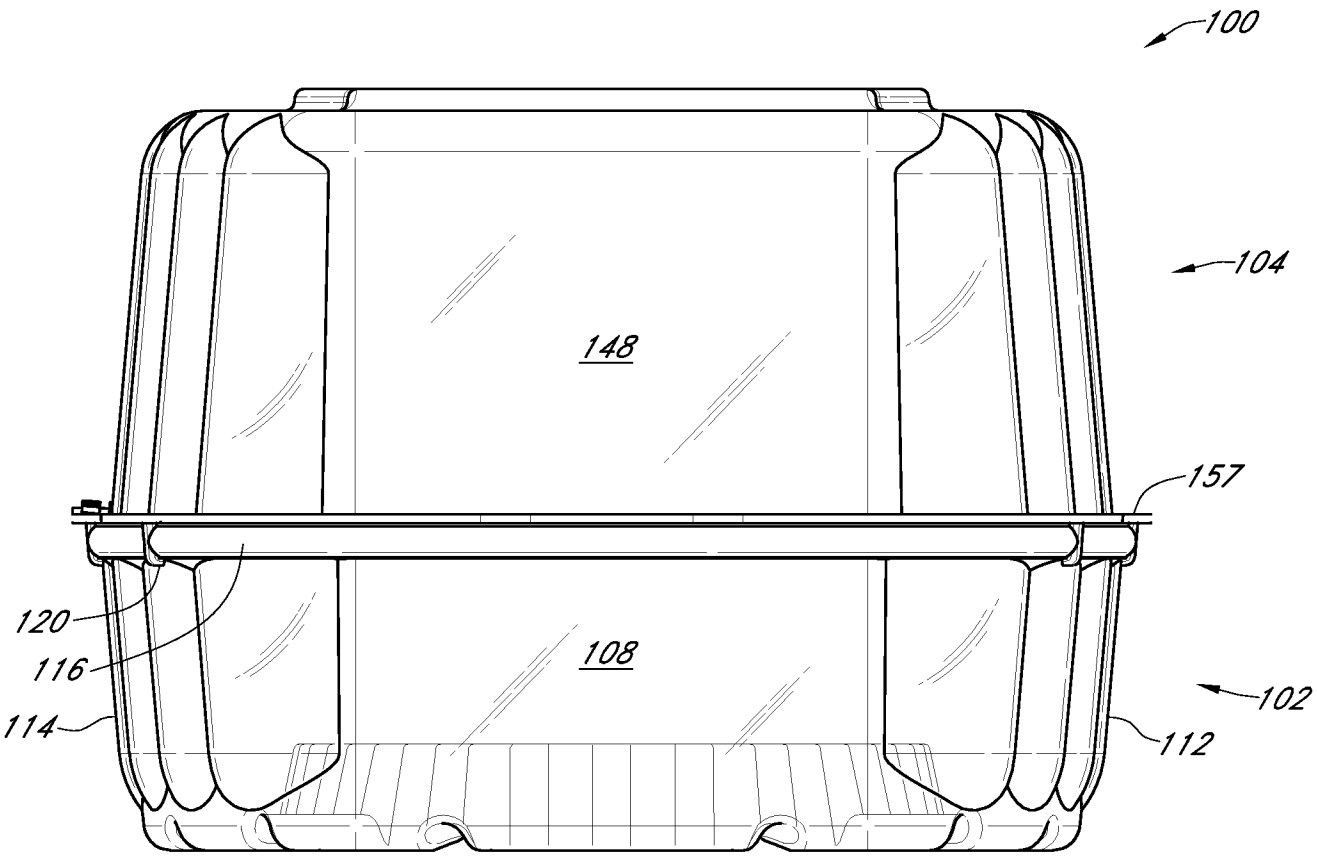
FIG. 5 illustrates a rear elevational view of the container of FIG. 1 in a closed configuration.

FIG. 1 illustrates a top perspective view of a two piece container in a closed configuration according to an embodiment of the invention. As shown, the container 100 may include a base 102 and a lid 104; the lid 104 may be releasably engaged to the base 104. The base 102 may include a bottom 106, having an inner side surface (i.e. the surface on the inside of the container) and an outer side surface (i.e. the surface on the outside of the container), as well as two opposing lower sidewalls 108 and 110 (See FIGS. 4-5) integrally connected to two opposing lower end walls 112 and 114. (See FIGS. 2-3) The lower sidewalls, 108 and 110, and lower end walls, 112 and 114, may extend continuously upwardly from the bottom 106 to form the base 102. The uppermost edges of the lower sidewalls 108, 110 and the uppermost edges of the lower end walls 112, 114 define a perimeter of the base 102 by which a lower flange 116 may be integrally connected thereto. The lower flange 116 may generally project in an outwardly or an approximately perpendicular fashion relative to the perimeter as defined previously.

The lower flange 116 may include a female recess dimensioned to receive a cooperating male rib in the lid 104 (described in further detail below). Furthermore, the lower flange 116 may include a plurality of pressure vents 120 for releasing internal pressure of the container 100 when the lid 104 is secured to the base 104. The plurality of pressure vents 120 may be either attached to, or may be formed integrally with, the lower flange 116.

The bottom of the base 102 may also include a wall member 124 integrally formed with, and separate the lower portion 122 from the upper portion 142 creating a retaining ring 132 within the base 102. (see FIG. 7) The wall member 124 may include an inner sidewall 125 and an outer sidewall 127 joined together at the uppermost edges by a flat planar top portion 129. In one embodiment the outer sidewall 127 may diverge outwardly from the flat planar top portion 129 to the lower portion 122 while the inner sidewall 125 may diverge outwardly from the flat planar top portion 129 to the upper portion 142. Located within the inner sidewall 125 and the outer sidewall 127 are a plurality of concave grooves 126 separated by a plurality of radially projecting protrusions 128. The plurality of concave grooves 126 and the plurality of radially projecting protrusions 128 are integrally connected together in a circular fashion equidistant from an outer circumference 130 of a circular protruding surface portion 134 located in the center of the upper portion 122.

The upper portion 142 of the bottom 106 of the base 102 may include a first plurality of stiffening ribs 138 projecting radially outward from the circumference 130 of the circular protruding surface portion 134 to the base of the inner sidewall 125 of the wall member 124. The first plurality of stiffening ribs 138 (See FIG. 7) may be formed integrally with the upper portion 142.

The lower portion 122 of the bottom 106 of the base 102, may include a second plurality of stiffening ribs 144 (See FIG. 7) projecting radially outward from the base of the outer sidewall 127 of the wall member 124 to the edge of the lower surface. In one embodiment, second plurality of stiffening ribs 144 may comprise a convex shape providing for channels on the outer side surface of the bottom of the base 102. As a result, when identical containers are stacked on top of each other, the channels allow air to flow through and ventilate completely throughout the stacked containers. The second plurality of stiffening ribs 144 may be formed integrally with the bottom 106 of the base 102.

In one embodiment, the two lower opposing sidewalls 108 and 110 may be formed of a flat, planar surface, while the two opposing lower end walls 110 and 112 may be a rounded or convex surface such that the four walls comprise a squircle. Additionally, the two opposing lower end walls 110 and 112 may include of a plurality longitudinal convex grooves to increase the rigidity of the lid 104 as well as allowing a consumer to easily grasp the lid 104.

The lid 104 may include a top 147 and two opposing upper sidewalls 148 and 150 integrally connected to two opposing upper end walls 152 and 154. The upper sidewalls, 148 and 150, and upper end walls, 152 and 154, extend continuously downwardly from the top 147 to form the lid 104. The lowermost edges of the upper sidewalls 148 and 150 and the upper end walls 152 and 154 define a perimeter of the lid 104 by which an upper flange 157 may be integrally connected thereto. Additionally, the upper end walls 152 and 154 may define a ribbing structure 156 to enhance the top load compression strength allowing for more containers to be stacked on top of each other. The perimeter of the lid 104 may include a male rib which may be received by the female recess of the base 102 when the lid 104 is placed onto the base 102 when closing the container 100. When engaged, the female recess and the male rib snap together, i.e. mate or engage, securely holding the lid 104 and base 102 of the container 100 together, providing rigidity to the container 100. The male rib may include a plurality of notches to add strength and stiffness to the male rib and when the lid 104 is engaged with the base 102.

In one embodiment, the two opposing upper sidewalls 148 and 150 may be formed of a flat, planar surface, while the two opposing upper end walls 152 and 154 may be formed of a rounded or convex surface such that the four walls comprise a squircle.

Figure 6:
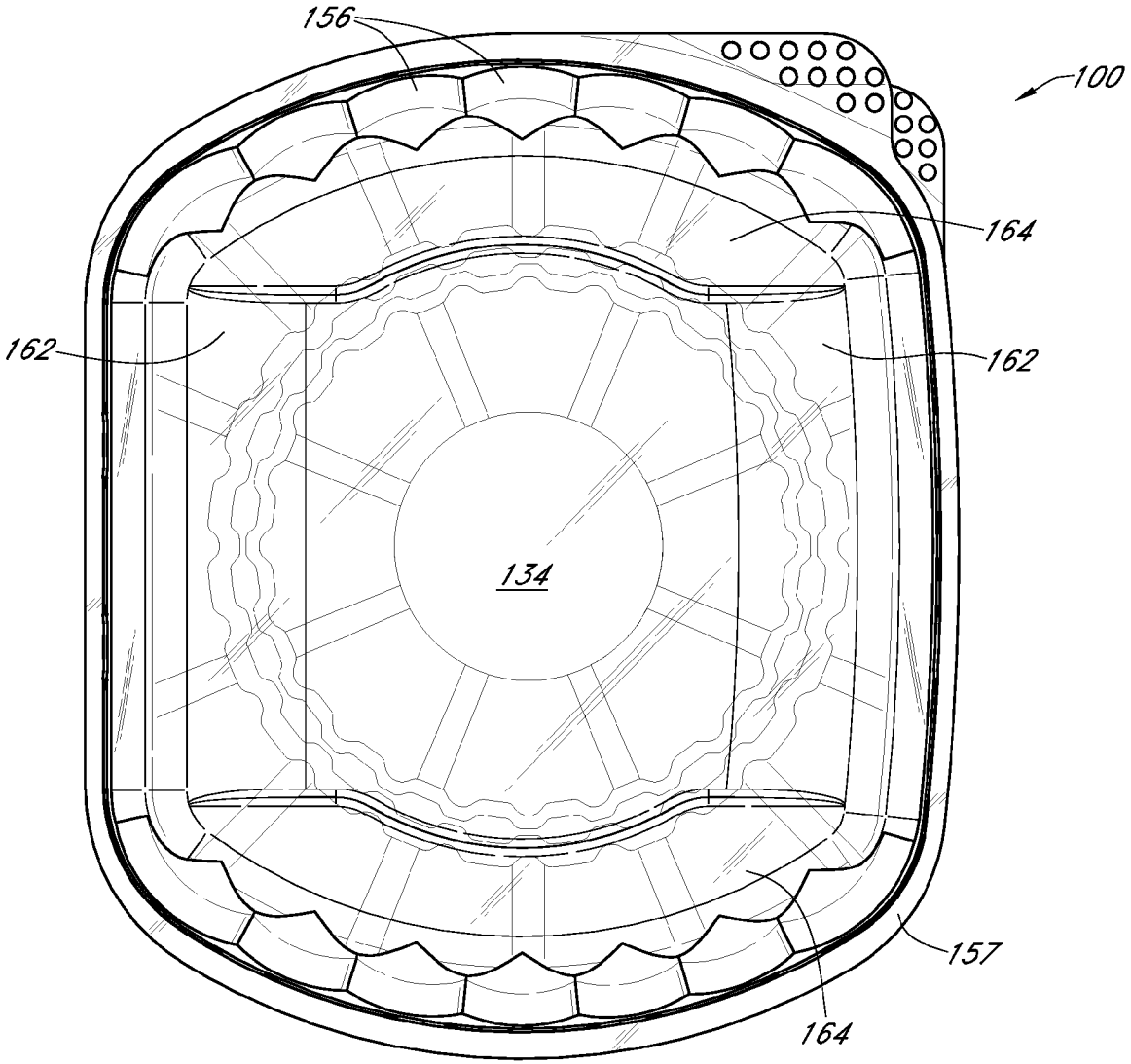
FIG. 6 illustrates a top plan view of the container of FIG. 1 in a closed configuration.
Figure 7:
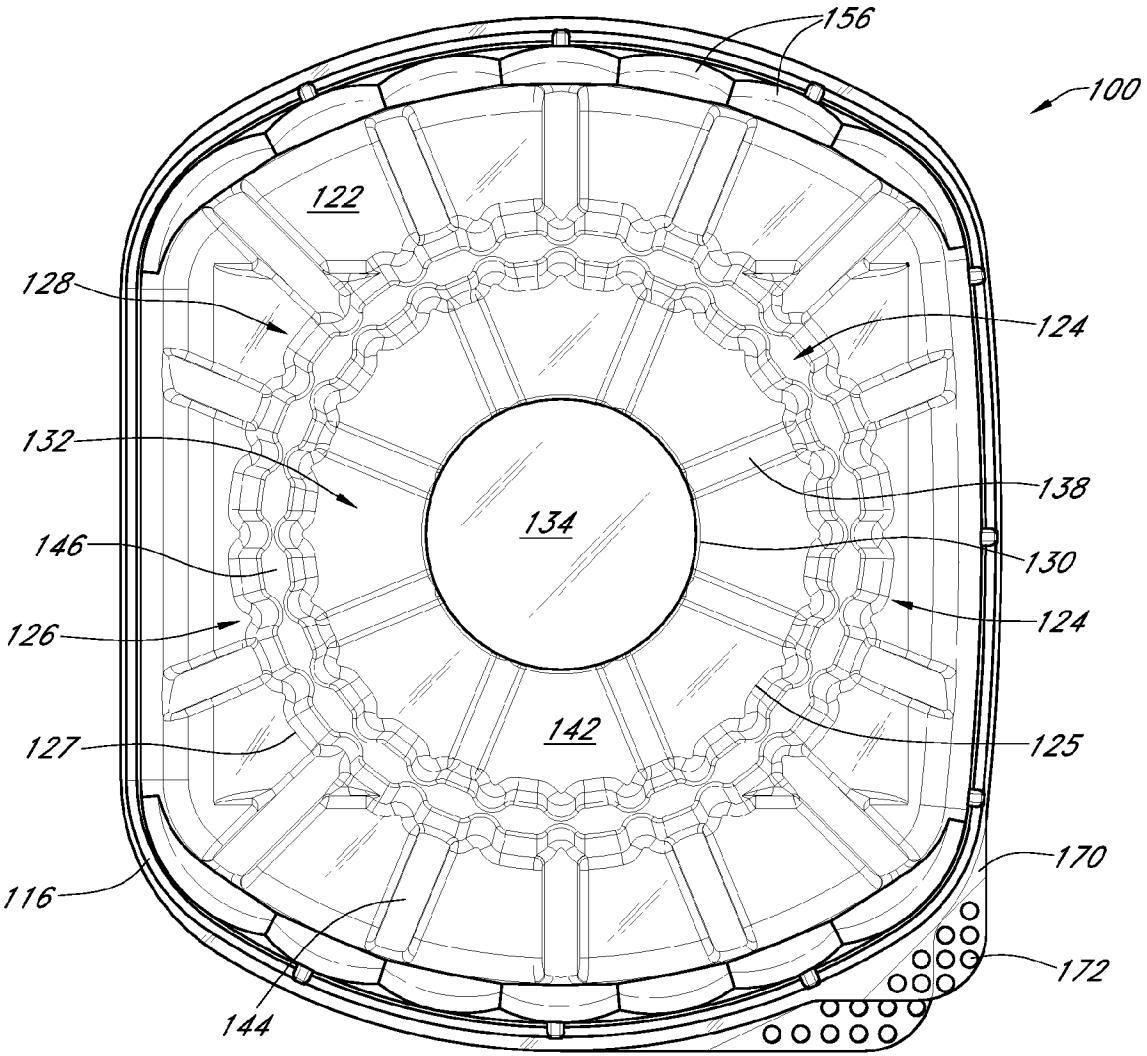
FIG. 7 illustrates a bottom plan view of the container of FIG. 1 in a closed configuration.
Figure 8:
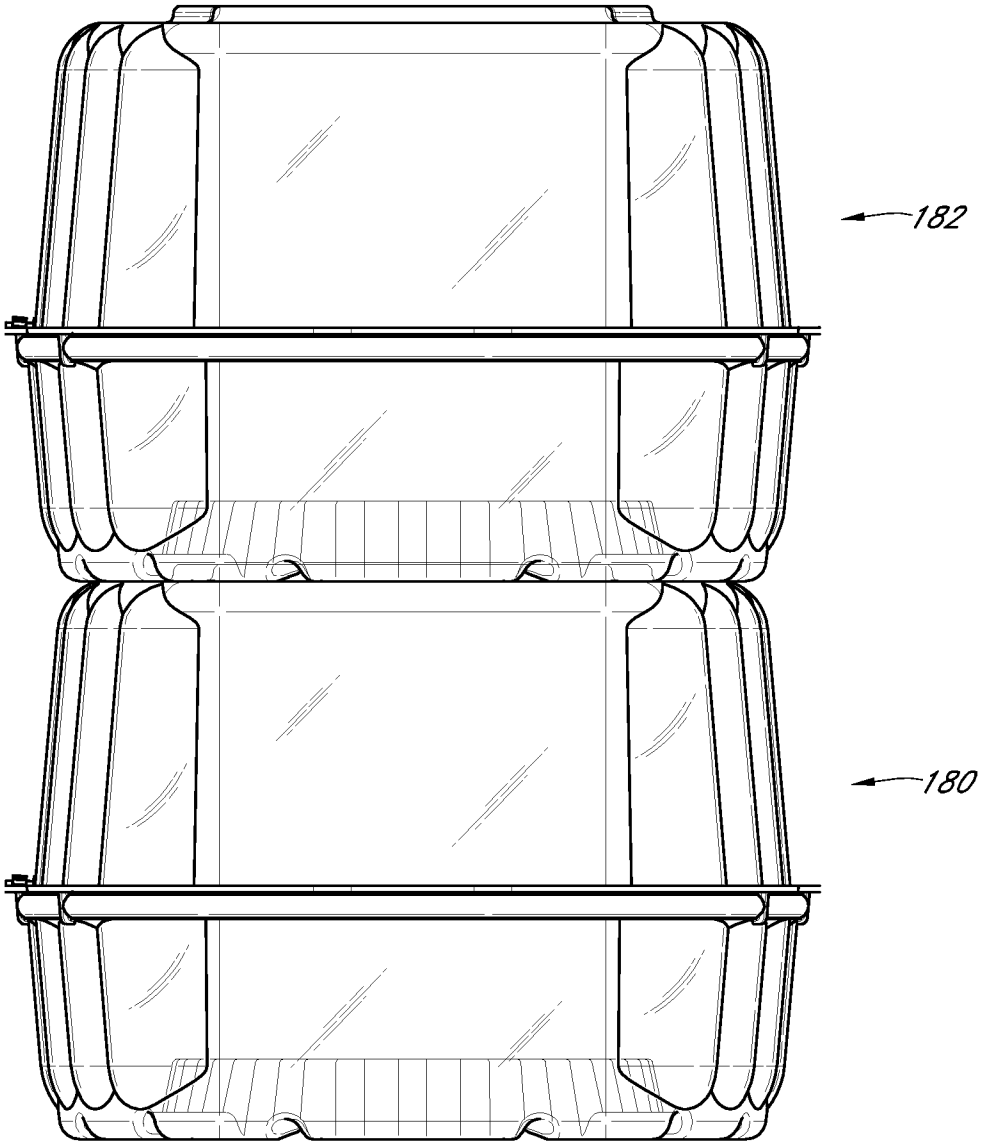
FIG. 8 illustrates a first container and a second identical container being stacked together according to an embodiment of the invention.

FIGS. 6-7 illustrate top and bottom plan views, respectively, of the container of FIG. 1 in a closed configuration. FIG. 8 illustrates a first container and a second identical container being stacked together according to an embodiment of the invention. The following discussion refers to FIGS. 6-8.

To facilitate stacking of multiple containers, the top 147 of the lid 104 may include a pair of upwardly sloping surfaces 160, 162 and a pair of a pair of downwardly sloping surfaces 164, 166 that extend along a first outer portion of the top 147, parallel to the upper sidewalls 148, 150 outer portion of the top 147 parallel to the upper end walls 152 and 154, respectively. Labels identifying the contents of the container may be placed on the pair of upwardly sloping surfaces 160 and 162 and/or the pair of a pair of downwardly sloping surfaces 164, 166.

The pair of upwardly sloping surfaces 160, 162 and the pair of downwardly sloping surfaces 164, 166 are designed to fit within the retaining ring 132, created by the outer sidewall 127 of the wall member 124 and the upper portion (described above), on the base of an identical container stacked on top. As the top of a first container 180 is designed to fit, and be received within a retaining ring in the outer side surface of the base of a second container 182, stacking of identical containers may limit the extent that the second (or upper) container can shift from sidewall to sidewall relative to the first (or lower) container 180. (See FIG. 8) In other words, it will serve to inhibit shifting of the upper container from sidewall to sidewall relative to the lower container. Furthermore, as the labels are affixed to the pair of upwardly sloping surfaces 160 and 162 and/or the pair of downwardly sloping surfaces 164 and 166 which are enclosed within the r retaining ring when stacked, the labels are protected from being torn off during transport.

Furthermore, as a result of the pair of upwardly sloping surfaces 160 and 162 and the pair of downwardly sloping surfaces 164 and 166 being received within the retaining ring 132, multiple containers may be securely and more compactly stored on top of each other. Consequently, more identical containers may be stacked in a smaller area allowing for more efficient transportation as fewer shipping receptacles are needed resulting in a savings in both transportation and storage costs.

In order to open the container 100, i.e. remove the lid 104 from the base 102, tab portions 170 formed at a corner of the upper flange 157 of the lid 104 and at a corner of the lower flange 116 of the base 102 may be pulled apart. Corresponding bumps 172 (also referred to as protrusions or indentations) may be provided in the tab portions 170 of both the lid 104 and the base 102 for allowing a consumer to easily and securely grip the tab portions 170 and pull them apart. The tab portions 170 may be slightly offset from each other to allow easier opening of the container 100. Alternatively, the tab portions 170 may be positioned to overlap each other once the lid 104 is placed onto and secured to the base 102. To open the container 100, the consumer may simply pull the tab portions 170 apart with sufficient force to separate the lid 104 and the base 102.

Figure 9:
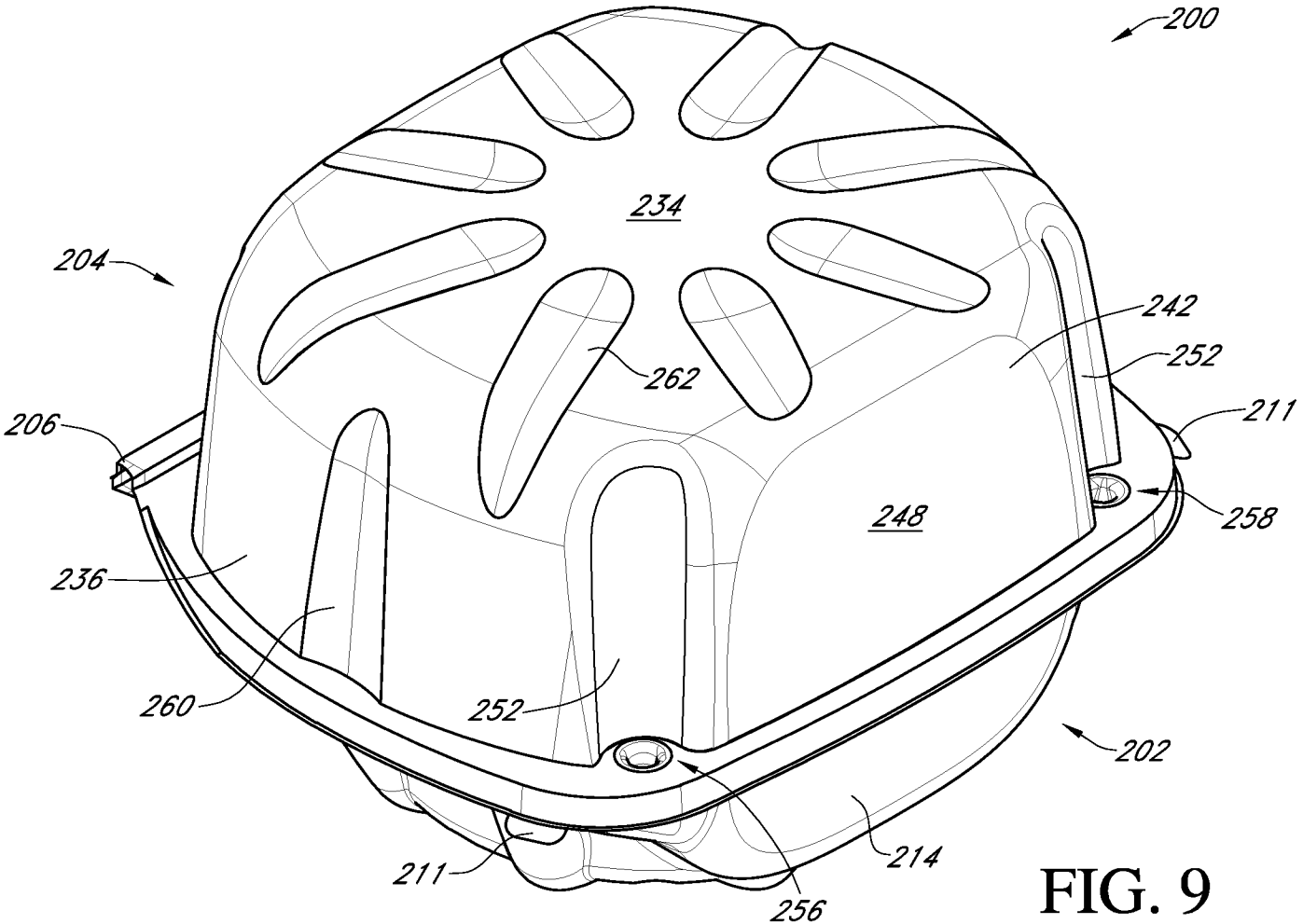
FIG. 9 illustrates a top perspective view of a container of the present invention in a closed configuration, according to one embodiment.
Figure 10:
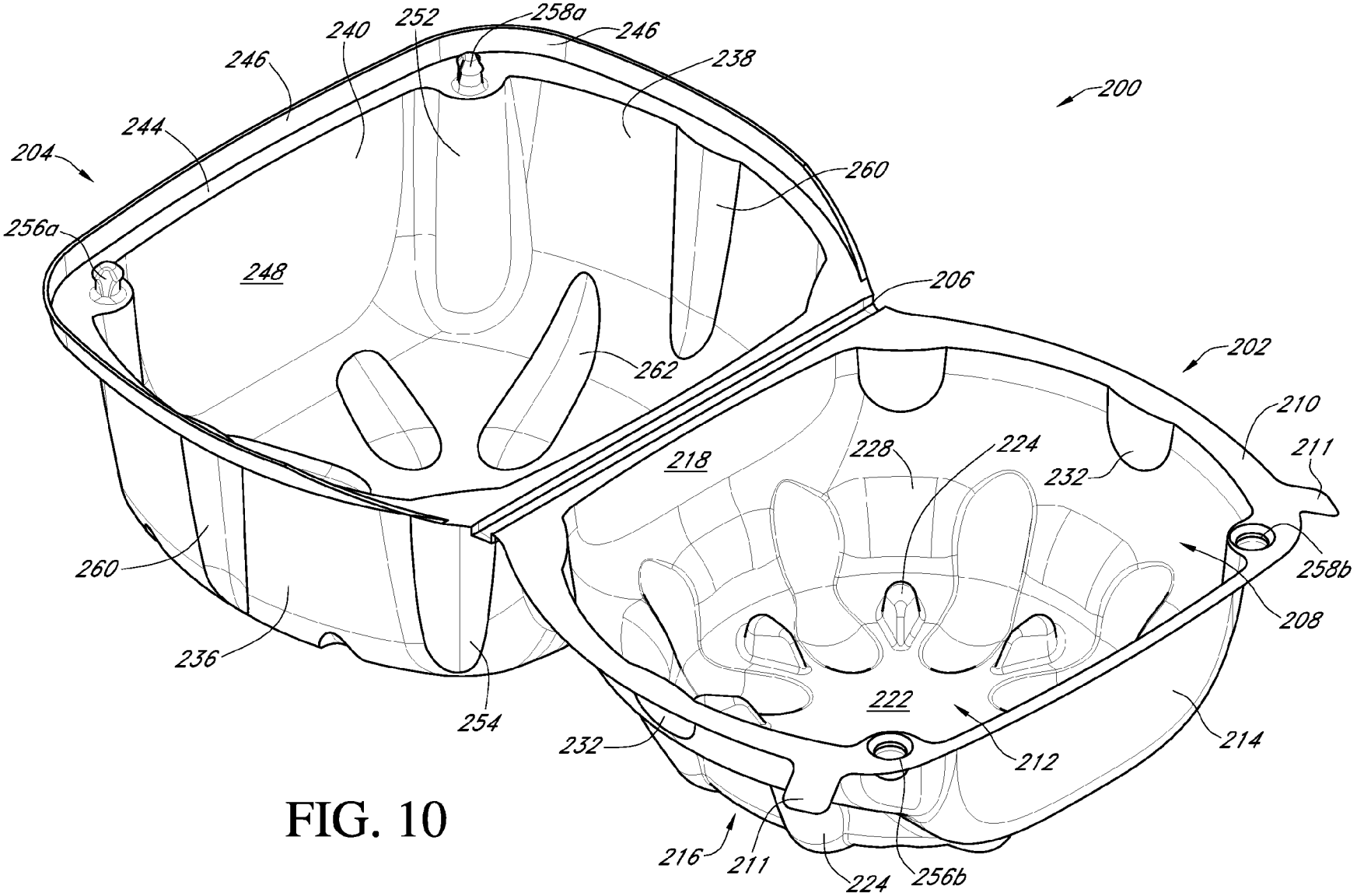
FIG. 10 illustrates a top perspective view of the container of FIG. 9 in an open configuration.
Figure 11:
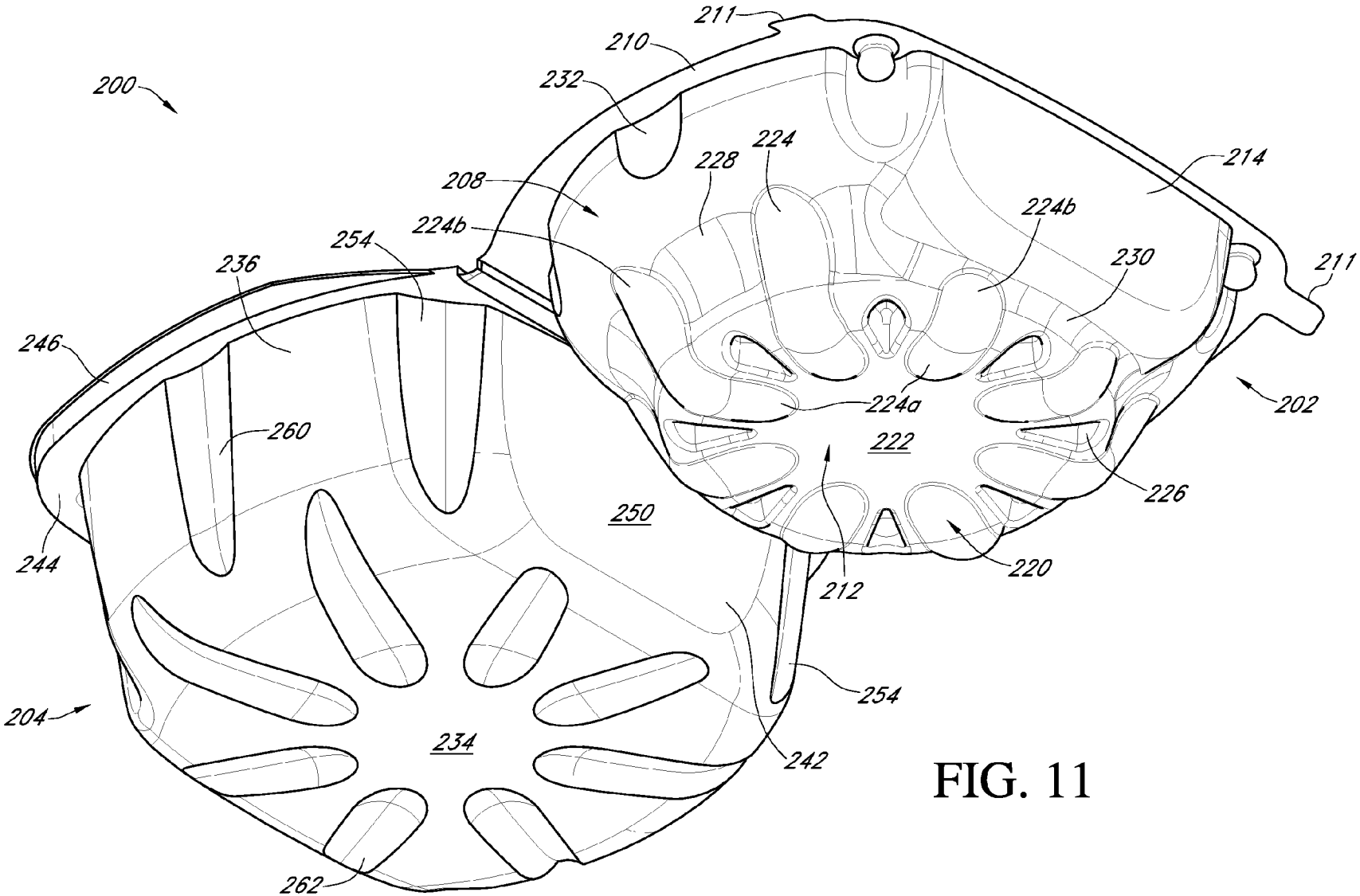
FIG. 11 illustrates a bottom perspective view of the container of FIG. 9 in an open configuration.
Figure 12:
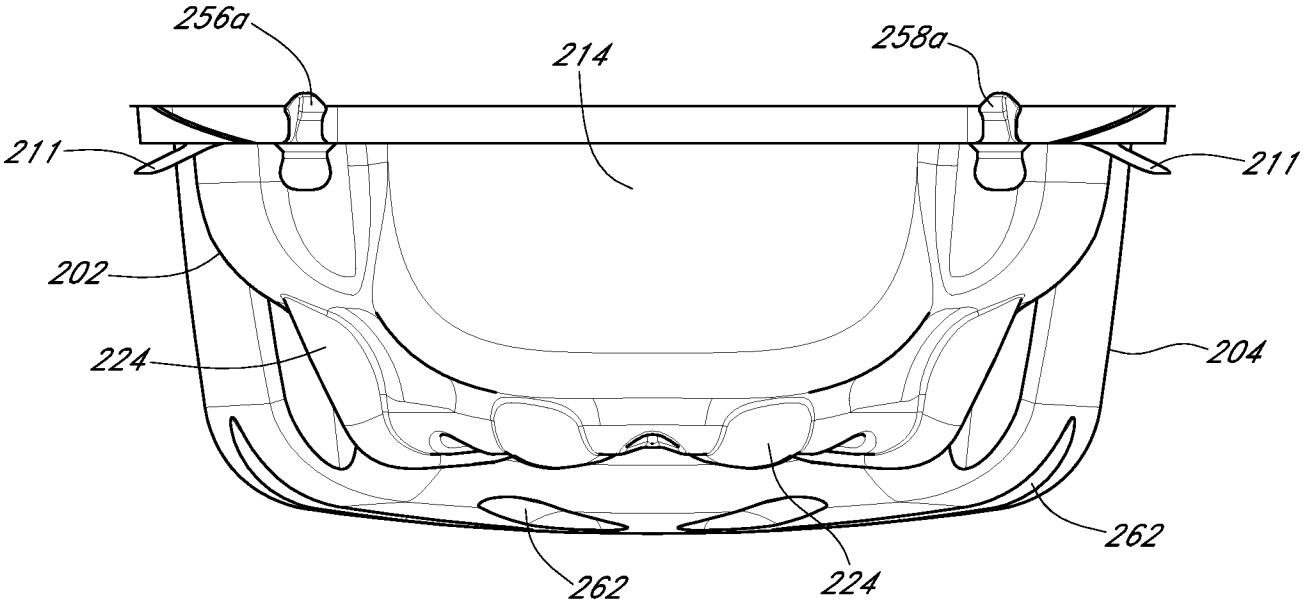
FIG. 12 illustrates a front elevantional view of the container of FIG. 9 in an open configuration.
Figure 13:
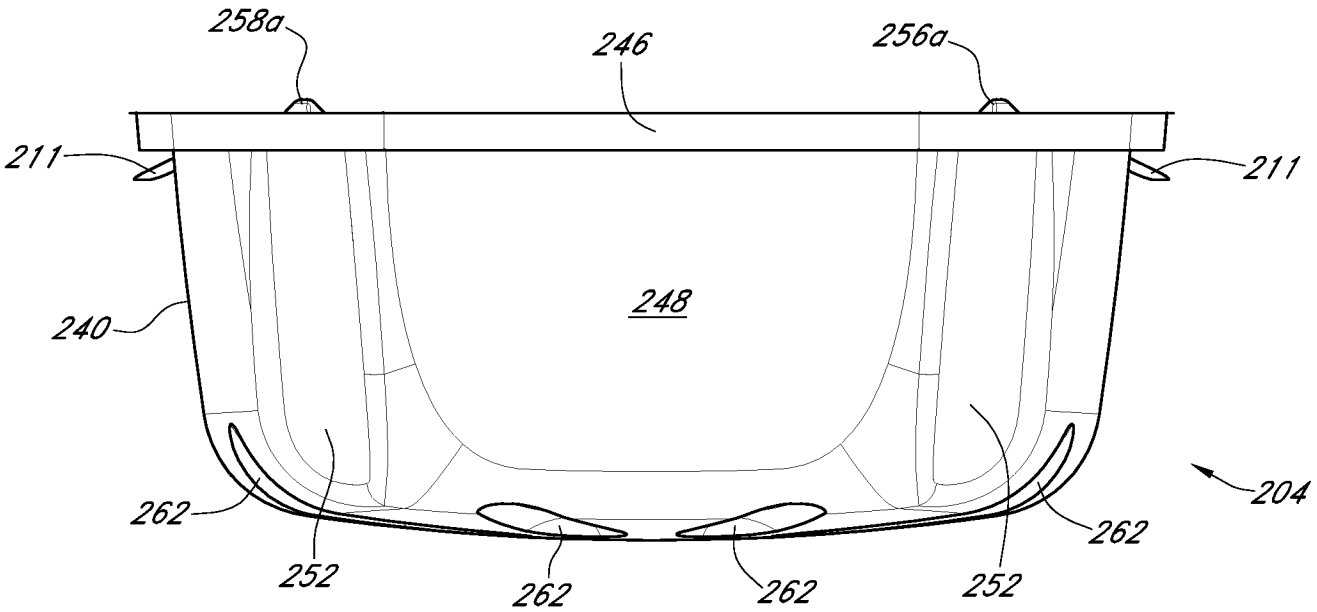
FIG. 13 illustrates a back elevantional view of the container of FIG. 9 in an open configuration, according to one embodiment.
Figure 14:
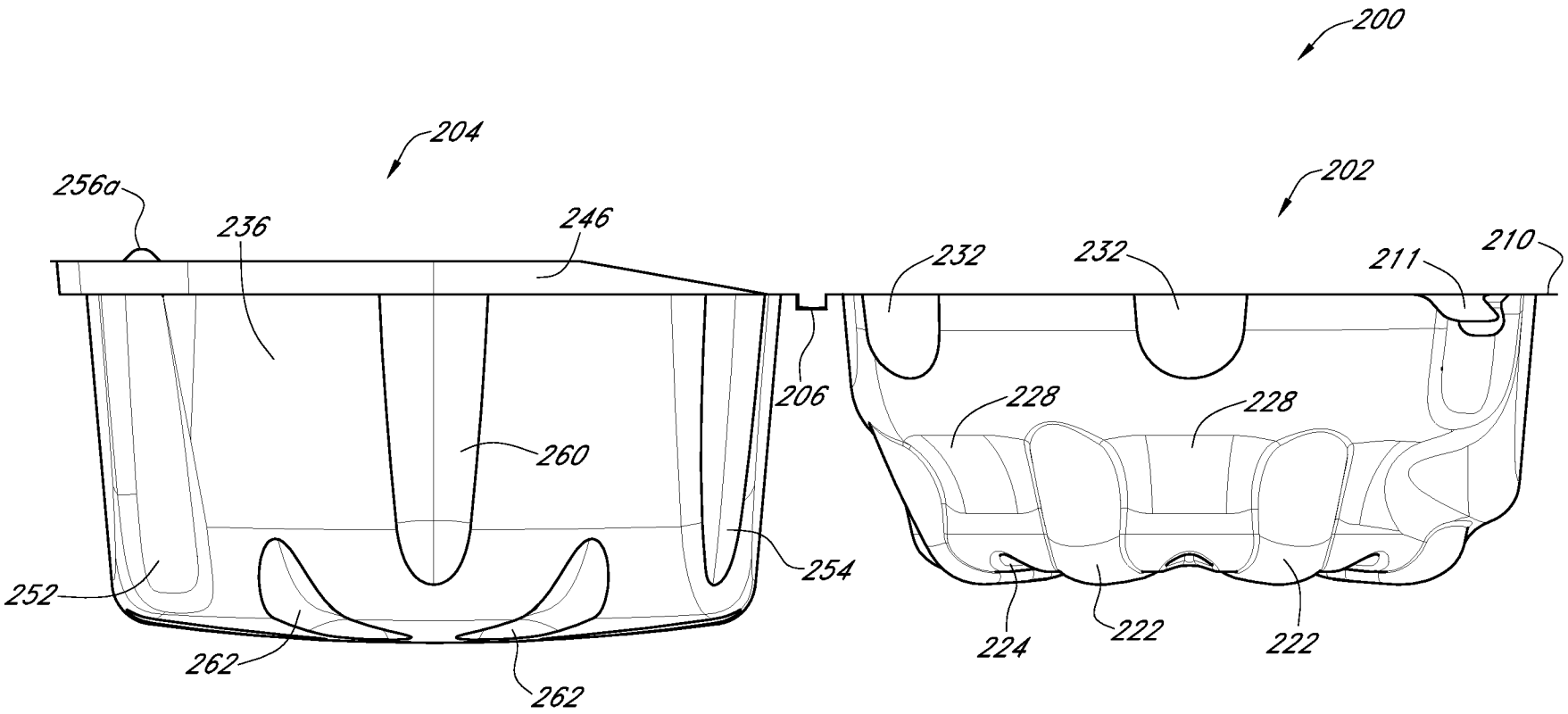
FIG. 14 illustrates a side elevantional view of the container of FIG. 9 in an open configuration, according to one embodiment.

FIG. 9 illustrates a top perspective view of a container of the present invention in a closed configuration, according to one embodiment. FIG. 10 illustrates a top perspective view of the container of FIG. 9 in an open configuration. FIG. 11 illustrates a bottom perspective view of the container FIG. 9 in an open configuration. The following discussion refers interchangeably to FIGS. 9-11.

As shown, the container 200 includes a base 202 connected to a lid 204 via a hinge 206. The base 202 includes a continuous body portion 208 and a continuous lower rim 210 encompassing and projecting laterally outward from the body portion 208. The continuous body portion 208 may include a generally circular bottom portion 212, a generally planar front surface portion 214 extending downwardly from the lower rim 210 and integrally connected to the circular bottom portion 212; however, other suitable shapes are within the scope of the invention. Furthermore, the continuous body portion 208 may include a continuous sidewall 216 encompassing and projecting upwardly and outwardly from the circular bottom portion 212. In one embodiment, the continuous sidewall 216 may include a generally planar back surface portion 218; opposite and parallel to the planar front surface portion 214, extending downwardly from the lower rim 210, at least partially down the continuous sidewall 216.

To facilitate stacking of multiple containers, the bottom portion 212 of the base 202 may be designed to fit, and be received within a top surface of an identical second container (See FIG. 15) which may limit the extent that the first (or upper) container can shift relative to the second (or lower) container. The generally circular bottom portion 212 may include an outer portion 220 surrounding a generally flat center portion 222. The outer portion 220 may include a plurality of longitudinal concave grooves 224 separated by a plurality of protrusions 226 projecting inwardly into the base 202 of the container 200. According to one embodiment, each of the plurality of longitudinal concave grooves 224 has a first end 224*a* and a second end 224*b*, where the first end 224*a* is located at an outer edge of the flat center portion 222 and each concave groove 224 projects laterally outward and at least partially up the continuous sidewall 216 terminating at the second end 224*b*. In one embodiment, the concave grooves 224 may be of different lengths. For example, as shown in FIG. 11, the concave grooves located in the front of the base 202 may extend up only to the flat planar front surface portion 214 while the concave grooves located on the side and back of the base 202 may extend farther up the continuous sidewall 216.

A plurality of lower depressions 228 may be located between each of the plurality of concave grooves 224 and extend from approximately slightly above the circular bottom portion 212 to slightly below or level (or even) with the second end 224*b* of the concave grooves 224. Each lower depression in the plurality of lower depressions 228 may have a generally rectangular shape; however, other suitable shapes are within the scope of the invention. In one embodiment, an elongated front depression 230 may extend below and along the length of the flat planar front surface portion 214.

According to one embodiment, the continuous body portion 208, between the flat planar front surface portion 212 and the planar back surface portion 216, may include a plurality of upper base depressions 232 extending downwardly from the lower rim 210 and spaced equal distances apart. The plurality of upper base depressions 232 may have a rounded bottom end and sides that diverge slightly outward up to the lower rim 210.

The lid 204 may include a top surface 234 and two opposing upper sidewalls 236, 238 integrally connected to two opposing upper end walls 240, 242. The upper sidewalls 236, 238 and upper end walls 240, 242, extend continuously downwardly from the top surface 234 to form the lid 204. The lowermost edges of the upper sidewalls 236 and 238 and the upper end walls 240, 242 define a perimeter of the lid 204 by which an upper rim 244 may be integrally connected thereto. The upper rim 244 may encompass and project laterally outwardly from the perimeter of the lid 204. According to one embodiment, the upper rim 244 may include a wall member 246 extending perpendicularly from the upper rim 244 and may be adapted to receive the lower rim 210 of the base 202 when the container 200 is in a closed configuration. When engaged, the lower rim 210 and the upper rim 244 snap together, i.e. mate or engage, securely holding the lid 204 and base 202 of the container 200 together, providing rigidity to the container 200. In one embodiment, the lower rim 210 may include tabs 211 for assisting an individual in separating the lid 204 from the base 202 when the container 200 is in a closed configuration.

In one embodiment, each of the two opposing upper end walls 240, 242 may include a generally flat, planar center portion 248, 250, respectively, located between a pair of longitudinal upper front depressions 252 and a pair of longitudinal upper back depressions 254, respectively, while the two opposing upper sidewalls 236, 238 may be formed of a generally rounded or convex surface such that the four walls comprise a super ellipse. The pair of longitudinal upper front depressions 252 and the pair of longitudinal upper back depressions 254 extend upwardly from the upper rim 244 to approximately the top surface 234 to enhance the top load compression strength allowing for more containers to be stacked on top of each other.

A pair of locking mechanisms 256, 258, to secure the lid 204 to the base 202, may be located in the upper rim 244, within the pair of longitudinal upper front depressions 252 located in the upper end wall 240. In this respect, locking mechanisms 256, 258 facilitate easy closure by packagers and prevent consumers from prematurely or easily opening the container 200 prior to sale. Additionally, locking mechanisms 256, 258 prevent the lid 204 from separating from the base 202 during transportation thereby spilling and/or damaging its contents. The pair of locking mechanisms 256, 258 may include extending latching portions 256*a*, 258*a* which may be received by circular openings 256*b*, 258*b*. When engaged, the extending latching portions 256*a*, 258*a* and circular openings 256*b* and 258*b* snap together thereby securely holding the lid 204 and base 202 of the container 200 together. Although two locking mechanisms 256, 258 are shown, the container 200 may have only one locking mechanism or may have more than two locking mechanisms.

According to one embodiment, the pair of longitudinal upper front depressions 252 may accommodate an individual's thumbs or other finger in preparation for securing the locking mechanisms 256, 258 (collectively 256*a*, 256*b* and 258*a*, 258*b*) by applying pressure to the extending latching portions 256*a*, 258*a* thereby engaging with circular openings 256*b*, 258*b*. Such action may alternatively be performed by automated closing equipment in a manufacturing environment.

According to one embodiment, a longitudinal upper center depression 260 may be located in each side wall 236, 238 so that when the lid 204 is secured to the base 202, the longitudinal upper center depressions 260, the pair of longitudinal upper front depressions 252 and the pair of longitudinal upper back depressions 254 may be in direct alignment with the plurality of upper base depressions 232 forming a substantially teardrop shape such that the sides of the depressions 252, 254 diverge inwardly coming to a rounded point at approximately the top surface 234 of the lid 204 and the plurality of upper base depressions 232 diverge outwardly coming to a rounded point in an upper portion of the continuous wall 208 of the base 202. However, in alternative embodiments, depressions 232, 252, 254 may have different shapes, such as oval, rectangular, or other polygons.

A plurality of longitudinal top depressions 262 may be located on the top surface 234 of the lid 204 and extend from an inner portion of the top surface 234 and project outwardly to the edges of the top surface 234 in a circular pattern. According to one embodiment, one or more of the longitudinal top depressions 262 may extend at least partially down the upper side walls 236, 238 such that the one or more longitudinal top depressions 262 may be located between the longitudinal upper center depression 260 and the longitudinal upper front and back depressions 252, 254. As described below, the plurality of longitudinal top depressions 262 of the lid 204 are adapted to receive the plurality of longitudinal concave grooves 224 of the base 202 when stacking containers.

Figure 15:
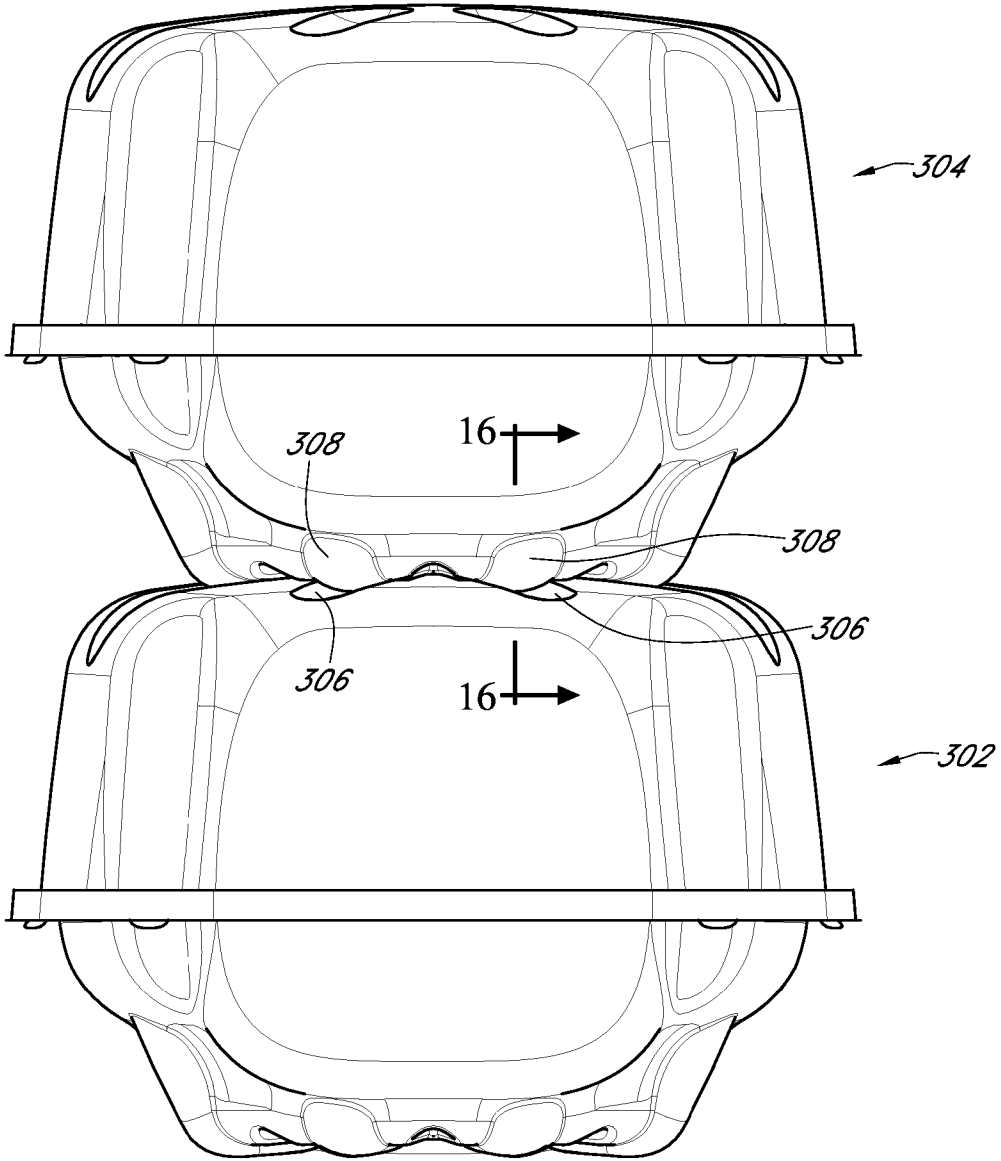
FIG. 15 illustrates a first container and a second identical container being stacked together according to an embodiment of the invention.

FIG. 15 illustrates a first container 302 and an identical second container 304 being stacked together according to an embodiment of the invention. To facilitate stacking of multiple containers, the top surface of the lid may include a plurality of longitudinal top depressions 306 adapted to receive a plurality of longitudinal concave grooves 308 on the bottom surface of the base. As the plurality of longitudinal top depressions 306 on top surface of the first container 302 is designed to fit, and be received within the plurality of longitudinal concave grooves 308 on the bottom surface of the base of the second container 304, stacking of identical containers may limit the extent that the second (or upper) container can shift from sidewall to sidewall relative to the first (or lower) container. In other words, it will serve to inhibit shifting of the upper container from sidewall to sidewall relative to the lower container.

Furthermore, as a result of the plurality of longitudinal concave grooves 308 being received within the longitudinal top depressions 306, multiple containers may be securely and more compactly stored on top of each other. Consequently, more identical containers may be stacked in a smaller area allowing for more efficient transportation as fewer shipping receptacles are needed resulting in a savings in both transportation and storage costs.

Figure 16:
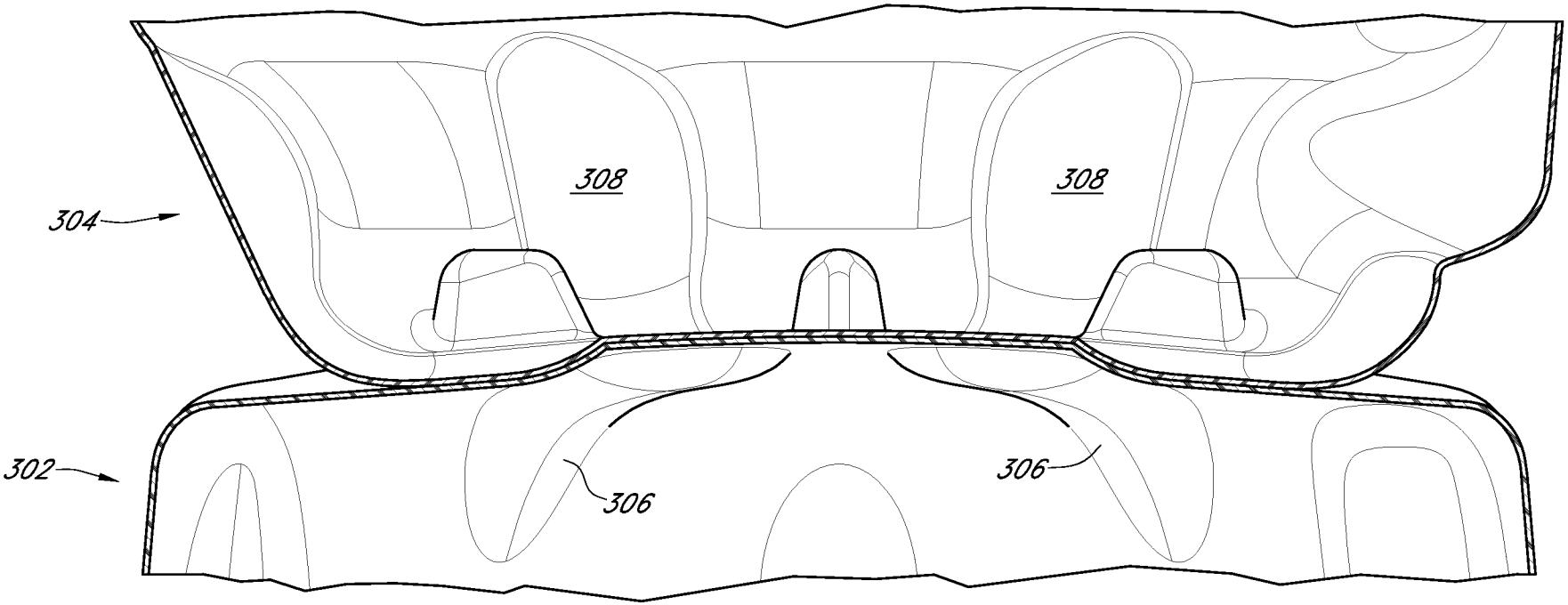
FIG. 16 illustrates a cross-sectional view of a "stacking feature" taken along line 16-16 of FIG. 15.

FIG. 16 illustrates a cross-sectional view of a "stacking feature" taken along line 16-16 of FIG. 15.

Figure 17:
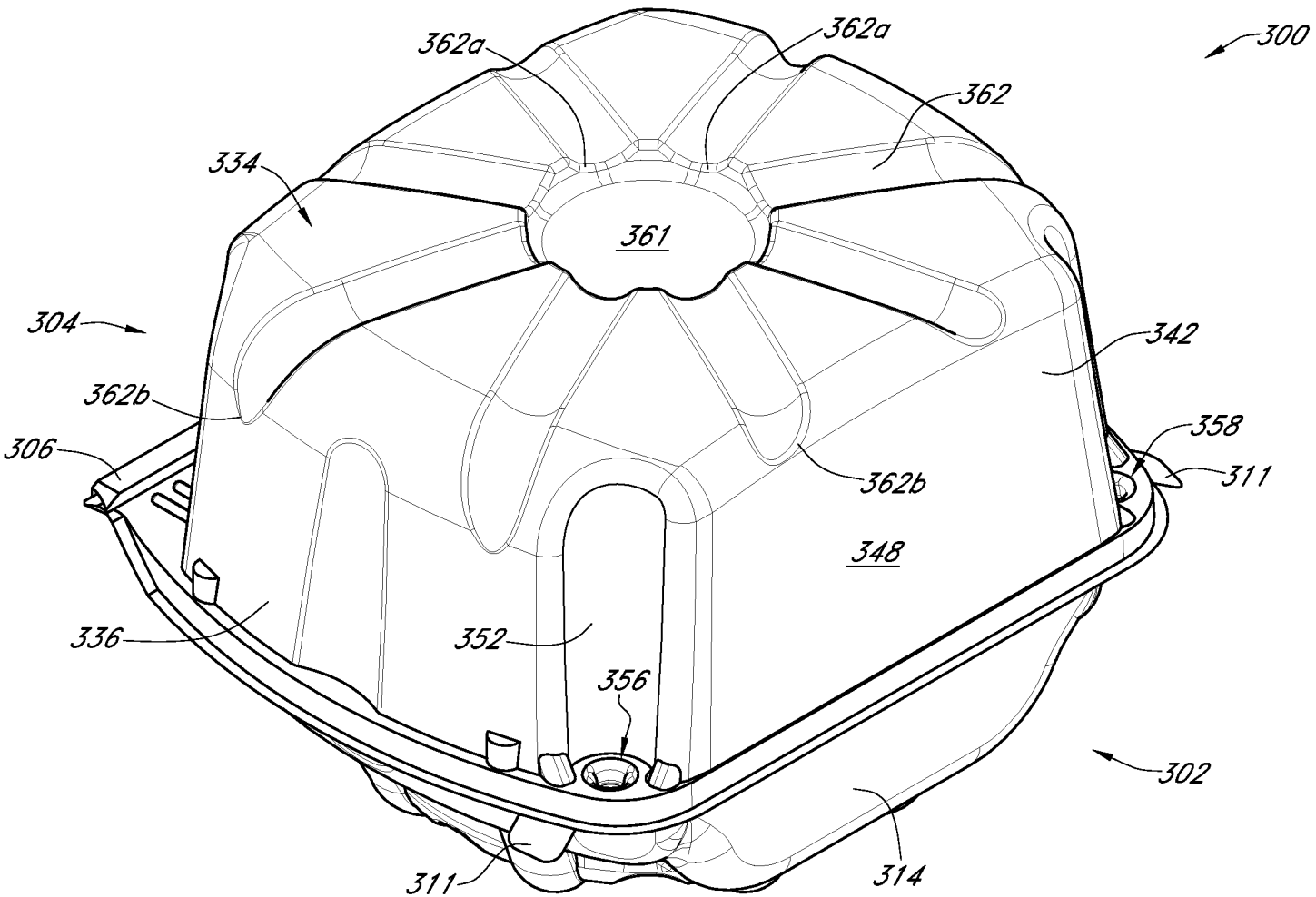
FIG. 17 illustrates a top perspective view of a container of the present invention in a closed configuration, according to one embodiment.
Figure 18:
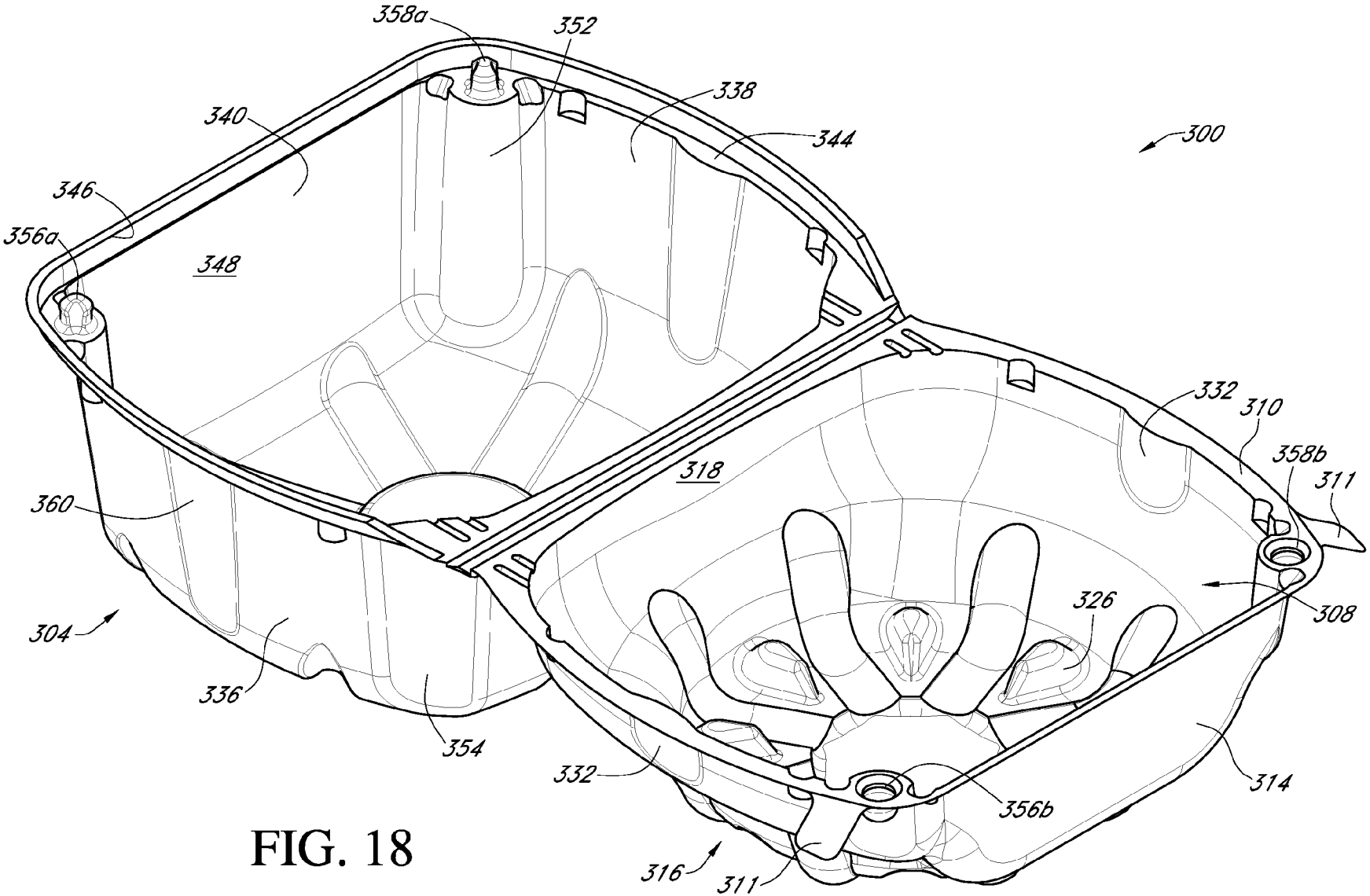
FIG. 18 illustrates a top perspective view of the container of FIG. 17 in an open configuration.
Figure 19:
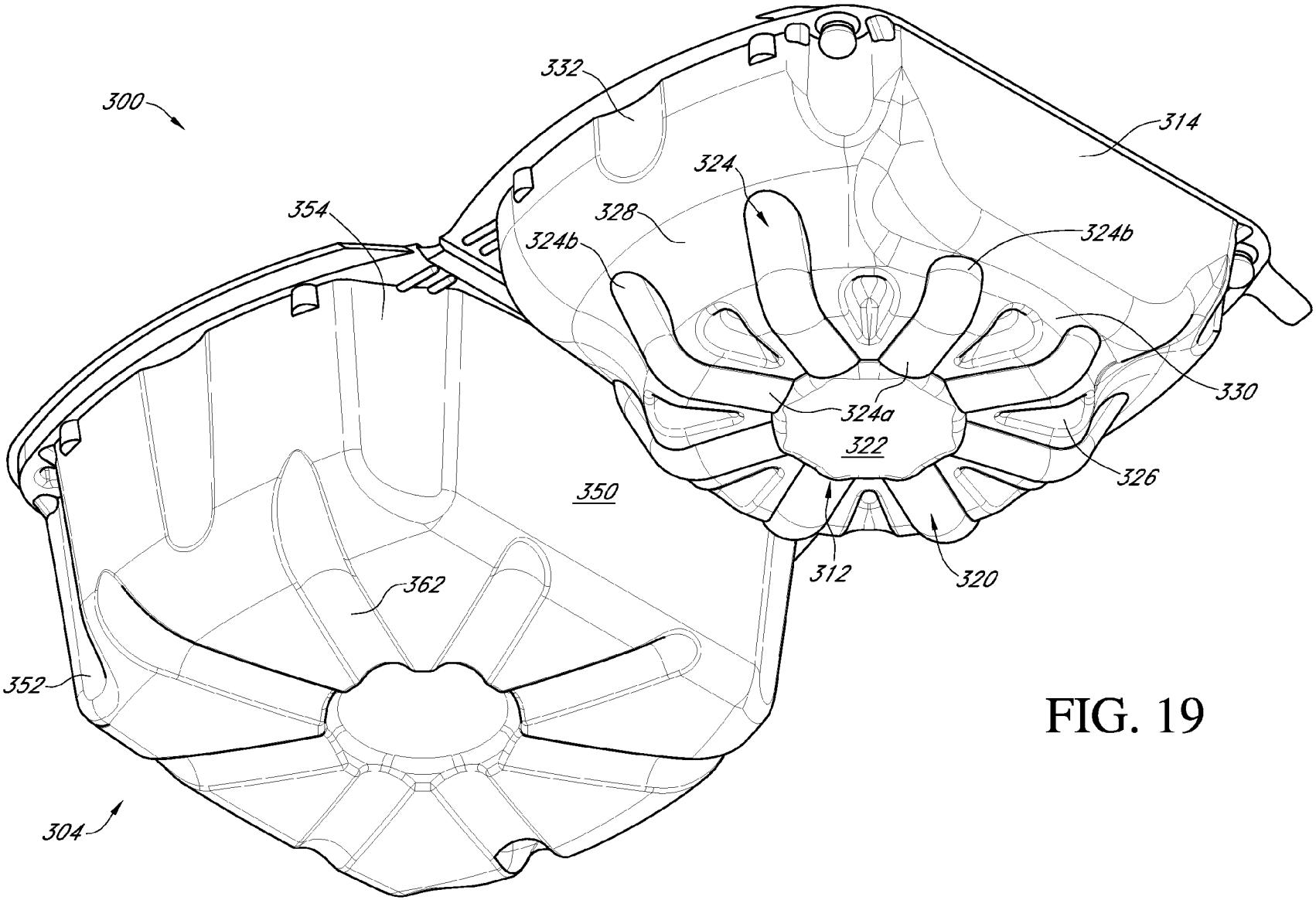
FIG. 19 illustrates a bottom perspective view of the container FIG. 17 in an open configuration.

FIG. 17 illustrates a top perspective view of a container of the present invention in a closed configuration, according to one embodiment. FIG. 18 illustrates a top perspective view of the container of FIG. 17 in an open configuration. FIG. 19 illustrates a bottom perspective view of the container FIG. 17 in an open configuration. The following discussion refers interchangeably to FIGS. 17-19.

As shown, the container 300 includes a base 302 connected to a lid 304 via a hinge 306. The base 302 includes a continuous body portion 308 and a continuous lower rim 310 encompassing and projecting laterally outward from the body portion 308. The continuous body portion 308 may include a generally circular bottom portion 312, a generally planar front surface portion 314 extending downwardly from the lower rim 310 and integrally connected to the circular bottom portion 312; however, other suitable shapes are within the scope of the invention. Furthermore, the continuous body portion 308 may include a continuous sidewall 316 encompassing and projecting upwardly and outwardly from the circular bottom portion 312. In one embodiment, the continuous sidewall 316 may include a generally planar back surface portion 318; opposite and parallel to the planar front surface portion 314, extending downwardly from the lower rim 310, at least partially down the continuous sidewall 316.

To facilitate stacking of multiple containers, the bottom portion 312 of the base 302 may be designed to fit, and be received within a top surface of an identical second container 300*b* (See FIG. 20) which may limit the extent that the first (or upper) container 300*a* can shift relative to the second (or lower) container 300*b*. The generally circular bottom portion 312 may include an outer portion 320 surrounding a generally circular male protruding center portion 322 that projects outwardly from an interior of the container 300. The outer portion 320 may include a plurality of longitudinal concave grooves 324 separated by a plurality of protrusions 326 projecting inwardly into the base 302 (i.e. interior) of the container 300. According to one embodiment, each of the plurality of longitudinal concave grooves 324 has a first end 324*a* and a second end 324*b*, where the first end 324*a* may have a generally flat edge abutting up against an outer edge of the flat protruding center portion 322 and each concave groove 324 projects laterally outward and at least partially up the continuous sidewall 316 terminating at the second end 324*b* having a generally curved edge. In one embodiment, the concave grooves 324 may be of different lengths. For example, as shown in FIG. 19, the concave grooves located in the front of the base 302 may extend up only to the flat planar front surface portion 314 while the concave grooves located on the side and back of the base 302 may extend farther up the continuous sidewall 316.

A plurality of lower depressions 328 may be located between each of the plurality of concave grooves 324 and extend from approximately slightly above the circular bottom portion 312 to slightly below or level (or even) with the second end 324*b* of the concave grooves 324. Each lower depression in the plurality of lower depressions 328 may have a generally rectangular shape; however, other suitable shapes are within the scope of the invention. In one embodiment, an elongated front depression 330 may extend horizontally below and along the length of the flat planar front surface portion 314.

According to one embodiment, the continuous body portion 308, between the flat planar front surface portion 312 and the planar back surface portion 316, may include a plurality of upper base depressions 332 extending downwardly from the lower rim 310 and spaced equal distances apart. The plurality of upper base depressions 332 may have a rounded bottom end and sides that diverge slightly outward up to the lower rim 310.

The lid 304 may include a top surface 334 and two opposing upper sidewalls 336, 338 integrally connected to two opposing upper end walls 340, 342. The upper sidewalls 336, 338 and upper end walls 340, 342, extend continuously downwardly from the top surface 334 to form the lid 304. The lowermost edges of the upper sidewalls 336 and 338 and the upper end walls 340, 342 define a perimeter of the lid 304 by which an upper rim 344 may be integrally connected thereto. The upper rim 344 may encompass and project laterally outwardly from the perimeter of the lid 304. According to one embodiment, the upper rim 344 may include a wall member 346 extending perpendicularly from the upper rim 344 and may be adapted to receive the lower rim 310 of the base 302 when the container 300 is in a closed configuration. When engaged, the lower rim 310 and the upper rim 344 snap together, i.e. mate or engage, securely holding the lid 304 and base 302 of the container 300 together, providing rigidity to the container 200. In one embodiment, the lower rim 310 may include tabs 311 for assisting an individual in separating the lid 304 from the base 302 when the container 300 is in a closed configuration. The tabs 311 may be beveled such that the tabs 311 extend outwardly downward for easier grasping and opening of the container by a consumer.

In one embodiment, each of the two opposing upper end walls 340, 342 may include a generally flat, planar center portion 348, 350, respectively, located between a pair of longitudinal upper front depressions 352 and a pair of longitudinal upper back depressions 354, respectively, while the two opposing upper sidewalls 336, 338 may be formed of a generally rounded or convex surface such that the four walls comprise a super ellipse. The pair of longitudinal upper front depressions 352 and the pair of longitudinal upper back depressions 354 extend upwardly from the upper rim 344 to approximately the top surface 334 to enhance the top load compression strength allowing for more containers to be stacked on top of each other.

A pair of locking mechanisms 356, 358 may be used to secure the lid 304 to the base 302. In this respect, locking mechanisms 356, 358 facilitate easy closure by packagers and prevent consumers from prematurely or easily opening the container 300 prior to sale. Additionally, locking mechanisms 356, 358 prevent the lid 304 from separating from the base 302 during transportation thereby spilling and/or damaging its contents. The pair of locking mechanisms 356, 358 may include extending latching portions 356*a*, 358*a*, located within the pair of longitudinal upper front depressions 352 in the upper end wall 340, which may be received by openings in circular members 356*b*, 358*b*, located with the lower rim 310.

When engaged, the extending latching portions 356*a*, 358*a* and circular members 356*b* and 358*b* snap together thereby securely holding the lid 304 and base 302 of the container 300 together. Although two locking mechanisms 356, 358 are shown, the container 300 may have only one locking mechanism or may have more than two locking mechanisms. Although the locking mechanism 356, 358 are shown as circular, this is by way of example only and any type of locking mechanism known in the art may be used. The circular members 356*b* and 358*b* may extend vertically downward, perpendicular to the lower rim 310, and then flare outwardly forming a generally bulbous configuration. When the extending latching portions 356*a*, 358*a* are inserted into the openings of the circular members 356*b* and 358*b*, the pair of concave grooves allowing that extending latching portions 356*a*, 358*a* to flex inwards allowing the extending latching portions 356*a*, 358*a* to be received into the openings of the circular members 356*b* and 358*b*. Once the extending latching portions 356*a*, 358*a* have been fully received with in the circular members 356*b* and 358*b*, the extending latching portions 356*a*, 358*a* expand back and are secured within the circular members 356*b* and 358*b*.

According to one embodiment, the extending latching portions 356*a*, 358*a* may include a pair of opposing grooves integrally connected to a pair of opposing pillars extending vertically from a bottom surface to a top surface of the extending latching portions 356*a*, 358*a*. The bottom surface integrally connected to the upper rim 344 and the top surface for receipt into the circular members 356*b*, 358*b*. Although a pair of concave grooves is shown, this is by way of example only and there may be more of less concave grooves.

According to one embodiment, the pair of longitudinal upper front depressions 352 may accommodate an individual's thumbs or other finger in preparation for securing the locking mechanisms 356, 358 (collectively 356*a*, 356*b* and 358*a*, 358*b*) by applying pressure to the extending latching portions 356*a*, 358*a* thereby engaging with circular members 356*b*, 358*b*. Such action may alternatively be performed by automated closing equipment in a manufacturing environment.

According to one embodiment, longitudinal upper center depressions 360 may be located in each side wall 336, 338 so that when the lid 304 is secured to the base 302, the longitudinal upper center depressions 360, the pair of longitudinal upper front depressions 352 and the pair of longitudinal upper back depressions 354 may be in direct alignment with the plurality of upper base depressions 332 forming a substantially teardrop shape such that the sides of the depressions 352, 354 diverge inwardly coming to a rounded point at approximately the top surface 334 of the lid 304 and the plurality of upper base depressions 332 diverge outwardly coming to a rounded point in an upper portion of the continuous wall 308 of the base 302. However, in alternative embodiments, depressions 332, 352, 354 may have different shapes, such as oval, rectangular, or other polygons.

A generally circular female recessed center portion 361, dimensioned to receive the generally circular male protruding center portion 322, may be located in the middle or center of the top surface 334 of the lid 304. A plurality of longitudinal top depressions 362 may be located on the top surface 334 of the lid 304. Each of the plurality of longitudinal top depressions 362 has a first end 362*a* and a second end 362*b*, where the first end 362*a* may have a generally flat semi-circular edge abutting up against an outer edge of the circular female recessed center portion 361 and each longitudinal top depression 362 projects laterally outward in a circular pattern across the top surface 334 of the lid 304 terminating at the second end 362*b* having a generally curved edge. The first ends 362*a* of the plurality of longitudinal top depressions 362 may form a scallop shape.

In one embodiment, the plurality of longitudinal top depressions 362 may extend at least partially down the opposing upper sidewalls 336, 338 and opposing upper end walls 340, 342 such that the one or more longitudinal top depressions 362 may be located between the longitudinal upper center depression 360 and the longitudinal upper front and back depressions 352, 354. As described below, the plurality of longitudinal top depressions 362 of the lid 304 are adapted to receive the plurality of longitudinal concave grooves 324 of the base 302 when stacking like containers.

Additionally, the plurality of longitudinal top depressions 362 may be of different lengths. For example, as shown in FIGS. 18 and 19, the plurality of longitudinal top depressions 362 may extend farther down the opposing upper sidewalls 336, 338 than the opposing upper end walls 340, 342.

Figure 20:
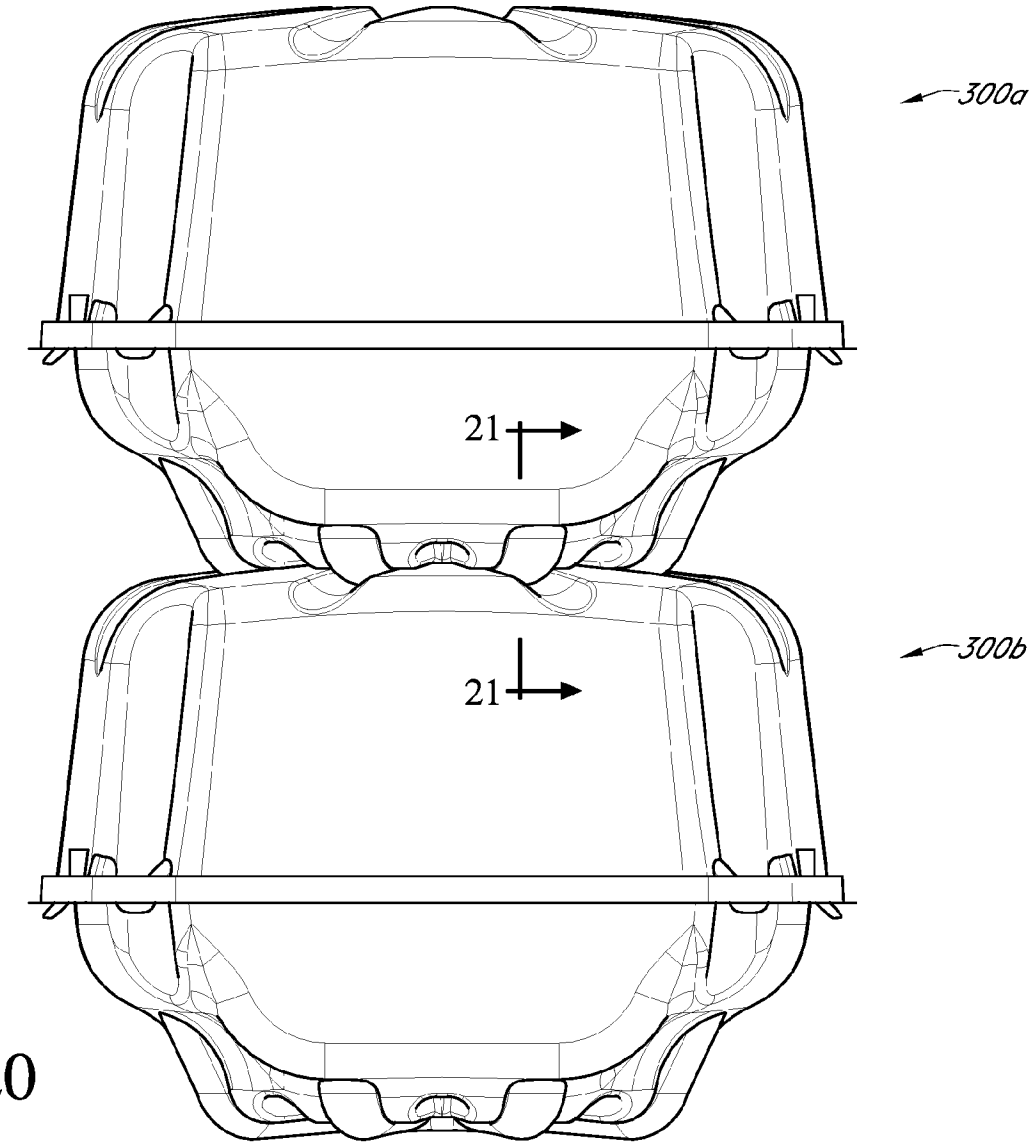
FIG. 20 illustrates a first container and a second identical container being stacked together according to an embodiment of the invention.

FIG. 20 illustrates a first container 300*a* and an identical second container 300*b* being stacked together according to an embodiment of the invention. As described above, to facilitate stacking of multiple containers, the circular female recessed center portion 361 on the top surface of the lids may be dimensioned to receive the circular male protruding center portion 322 of the bases. Additionally, the top surface of the lids may include a plurality of longitudinal top depressions 362 adapted to receive a plurality of longitudinal concave grooves 324 on the bottom surface of the bases. As the plurality of longitudinal top depressions 362 on the top surface of the first container 300*a* is designed to fit, and be received within the plurality of longitudinal concave grooves 324 on the bottom surface of the base of the second container 300*b*, stacking of identical containers may limit the extent that the first (or upper) container 300*a* can shift from sidewall to sidewall relative to the second (or lower) container 300*b*. In other words, it will serve to inhibit shifting of the upper container from sidewall to sidewall relative to the lower container.

Furthermore, as a result of the plurality of longitudinal concave grooves 362 being received within the longitudinal top depressions 324, multiple containers may be securely and more compactly stored on top of each other. Consequently, more identical containers may be stacked in a smaller area allowing for more efficient transportation as fewer shipping receptacles are needed resulting in a savings in both transportation and storage costs.

Figure 21:
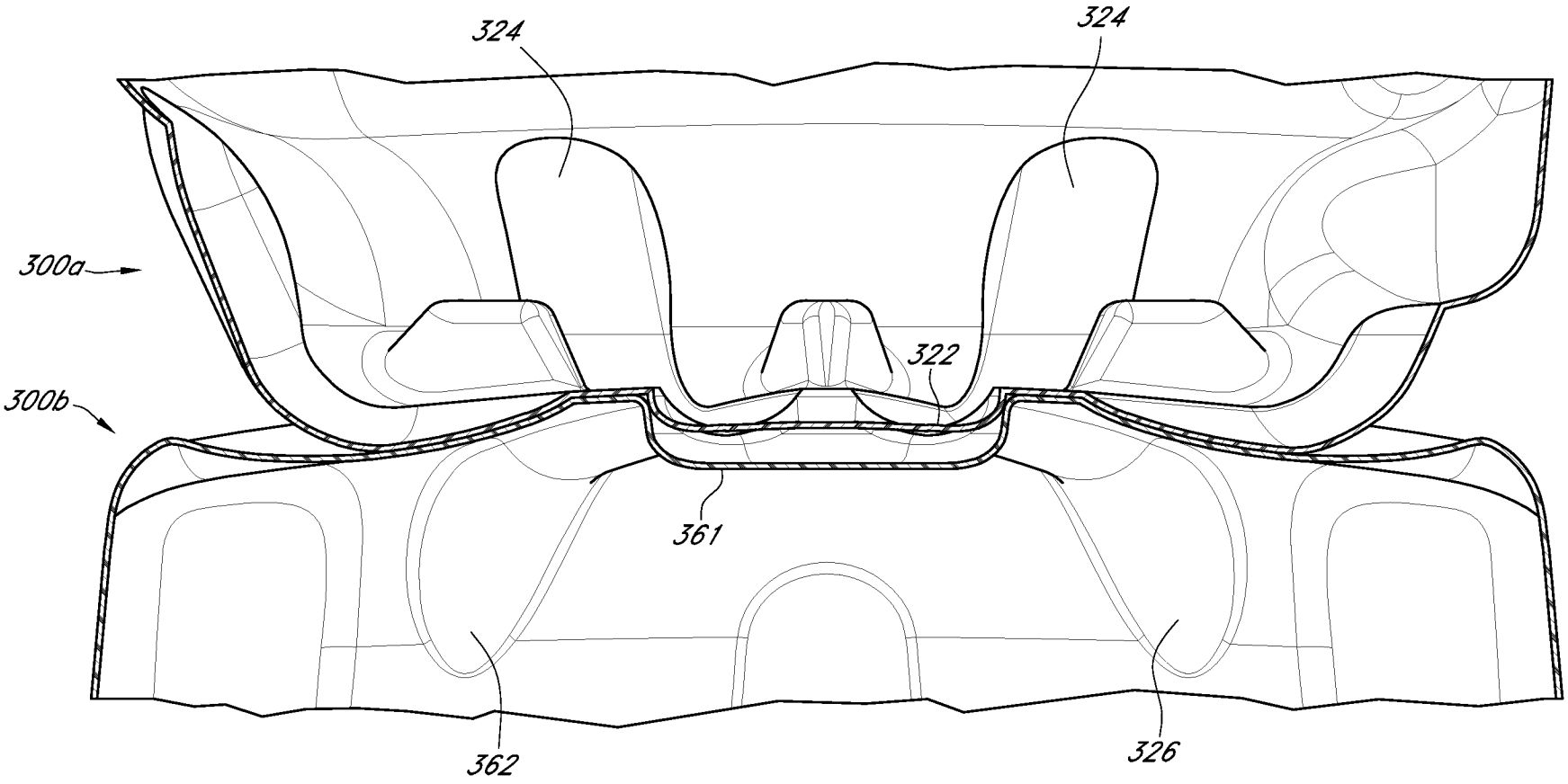
FIG. 21 illustrates a cross-sectional view of a "stacking feature" taken along line 21-21 of FIG. 20.

FIG. 21 illustrates a cross-sectional view of a "stacking feature" taken along line 21-21 of FIG. 20.

According to various embodiments, the containers described above, including their various components may be constructed of materials such as polyethylene terephthalate (PET), polystyrenes, polypropylenes, or any other suitable material known in the art. In a preferred embodiment, the containers may contain recycled PET or other plastic. This feature makes the containers recyclable.

The unique design of the containers of the present invention provide for containers that store the same amount of product or produce (such as lettuce) as conventional container, but with less container. That is, the containers of the present invention utilize less space and less material to make, but provide storage for the same amount of produce resulting in cost savings and environmental savings.

One advantage of the design of the container of the present invention is that the container may easily package and store produce harvested with its roots intact. Produce which is harvested and packaged with its roots intact has the ability to retain freshness and flavor for longer than conventionally harvested vegetables as the packaging may promote a micro-environment which may extend the life of the produce.

According to the first embodiment, when the produce is placed in the base 102 of the container 100, the roots may be placed and contained within the retaining ring. By placing the roots in the retaining ring 132, soil, soil debris and moisture may be kept within the retaining ring away from the remaining portions of the produce so that the freshness of the food packed and transported within the container is maintained. Once the produce is placed inside, the lid 104 may be secured to the base 102 creating the micro-environment.

According to the second embodiment, the generally circular bottom portion 212 (i.e. form fitting bottom) of the base 202 eliminates unused space around the roots when the produce is placed in the base 202. The plurality of protrusions 226 in the generally circular bottom portion 212 allow the produce to be separated from the roots keeping soil, soil debris and moisture away so that the freshness of the food packed and transported within the container 200 is maintained.

According to the third embodiment, the circular female recessed center portion 361 on the top surface of the lids are dimensioned to receive the circular male protruding center portion 322 of the bases and the plurality of longitudinal top depressions 362 on the lids are adapted to receive the plurality of longitudinal concave grooves 324 on the bottom surface of the bases. As a result, when stacking like containers, the shifting of the upper container from sidewall to sidewall relative to the lower container will be inhibited.

One or more of the components and functions illustrated in the previous figures may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A container, comprising:

a base having a continuous body portion and a lower rim encompassing and projecting laterally outwardly from the continuous body portion, the continuous body portion comprising:

a circular bottom portion having a substantially circular male protruding center portion projecting outwardly from the base;

a front surface portion extending downwardly from the lower rim and integrally connected to the circular bottom portion;

a lower body portion having a continuous sidewall encompassing and projecting upwardly and outwardly from the circular bottom portion, the continuous sidewall having a back surface portion opposite and parallel to the front surface portion and extending downwardly from the lower rim;

a plurality of longitudinal concave grooves having a first end and a second end, the first end separated by a plurality of protrusions projecting inwardly into the base; and a lid, hingedly connected to the base, the lid comprising:

a top surface having a substantially circular recessed center portion projecting inwardly into the top surface, the substantially circular recessed center portion dimensioned to receive a substantially circular male protruding center portion of an identical container base stacked on top of the lid;

a pair of upper sidewalls; and a pair of upper end walls integrally connected to the top surface and the pair of upper sidewalls; and wherein an edge of the pair of upper sidewalls and the pair of upper end walls extend outwardly to form an upper rim.

2. The container of claim 1, wherein the substantially circular male protruding center portion includes a lower surface positioned below, and parallel to, and an upper surface of the circular bottom portion is circular.

3. The container of claim 1, wherein the lid further comprises a plurality of longitudinal top depressions located on the top surface of the lid projecting outwardly in a circular pattern from an outer edge of the substantially circular recessed center portion.

4. The container of claim 3, wherein the plurality of longitudinal top depressions of a bottom container is adapted to receive the plurality of longitudinal concave grooves of a top container when the top container is stacked on top of the bottom container.

5. The container of claim 1, wherein the plurality of longitudinal concave grooves and the plurality of protrusions are integrally connected together in a circular fashion.

6. The container of claim 1, wherein each of the plurality of longitudinal concave grooves on the base is formed at an outer edge of the substantially circular male protruding center portion and project laterally outward at least partially up the continuous sidewall.

7. The container of claim 1, wherein the second end of the plurality of longitudinal concave grooves are separated by a plurality of lower depressions.

8. The container of claim 1, wherein the pair of upper sidewalls and the pair of upper end walls are integrally connected via a pair of upper front depressions and a pair of upper back depressions.

9. The container of claim 8, wherein a longitudinal upper center depression is located in each of the pair of upper sidewalls between one of the pair of upper front depressions and one of the pair of upper back depressions.

10. The container of claim 9, wherein the longitudinal upper center depression located in the each of the pair of upper sidewalls diverges inwardly coming to a rounded point at approximately the top surface of the lid.

11. The container of claim 10, wherein the continuous body portion of the base, between the front surface portion and the back surface portion, includes a plurality of upper base depressions extending downwardly from the lower rim and spaced equal distances apart.

12. The container of claim 11, wherein the plurality of upper base depressions have a rounded bottom end and sides that diverge outward up to the lower rim; and wherein when the lid is engaged with the base, the longitudinal upper center depression located in the each of the pair of upper sidewalls, the pair of upper front depressions and the pair of upper back depressions are in alignment with the plurality of upper base depressions forming a teardrop shape.

13. A container, comprising:

a base having a continuous body portion and a lower rim encompassing and projecting laterally outwardly from the continuous body portion, the continuous body portion comprising:

a circular bottom portion having a substantially circular male protruding center portion projecting outwardly from the base;

a front surface portion extending downwardly from the lower rim and integrally connected to the bottom portion; and a lower body portion having a continuous sidewall encompassing and projecting upwardly and outwardly from the bottom portion, the continuous sidewall having a back surface portion opposite and parallel to the front surface portion and extending downwardly from the lower rim;

a plurality of longitudinal concave grooves having a first end and a second end, the first end separated by a plurality of protrusions projecting inwardly into the base; and a lid, hingedly connected to the base, the lid comprising:

a top surface having a substantially circular recessed center portion projecting inwardly into the top surface, the substantially circular recessed center portion dimensioned to receive a substantially circular male protruding center portion of an identical container base stacked on top of the lid;

a pair of upper sidewalls;

a pair of upper end walls integrally connected to the top surface and the upper sidewalls, wherein an edge of the pair of upper sidewalls and the pair of upper end walls extend outwardly to form an upper rim; and a plurality of longitudinal top depressions located on the top surface of the lid projecting outwardly in a circular pattern from an inner portion of the top surface, wherein the plurality of longitudinal top depressions of a bottom container is adapted to receive the plurality of longitudinal concave grooves of a top container when the top container is stacked on top of the bottom container.

14. The container of claim 13, wherein the pair of upper sidewalls and the pair of upper end walls are integrally connected via a pair of upper front depressions and a pair of upper back depressions.

15. The container of claim 14, wherein a longitudinal upper center depression is located in each of the pair of upper sidewalls between one of the pair of upper front depressions and one of the pair of upper back depressions.

16. The container of claim 15, wherein the longitudinal upper center depression located in the each of the pair of upper sidewalls diverge inwardly coming to a rounded point at approximately the top surface of the lid.

17. The container of claim 16, wherein the continuous body portion of the base, between the front surface portion and the back surface portion, includes a plurality of upper base depressions extending downwardly from the lower rim and spaced equal distances apart.

18. The container of claim 17, wherein the plurality of upper base depressions have a rounded bottom end and sides that diverge outward up to the lower rim; and wherein when the lid is engaged with the base, the longitudinal upper center depression located in the each of the pair of upper sidewalls, the pair of upper front depressions and the pair of upper back depressions are in alignment with the plurality of upper base depressions forming a teardrop shape.

19. A container, comprising:

a base having a continuous body portion and a lower rim encompassing and projecting laterally outwardly from the continuous body portion, the continuous body portion comprising:

a circular bottom portion having a substantially circular male protruding center portion projecting outwardly from the base;

a front surface portion extending downwardly from the lower rim and integrally connected to the circular bottom portion;

a lower body portion having a continuous sidewall encompassing and projecting upwardly and outwardly from the circular bottom portion, the continuous sidewall having a back surface portion opposite and parallel to the front surface portion and extending downwardly from the lower rim; and a plurality of longitudinal concave grooves projecting laterally outward from the substantially circular male protruding center portion; and a lid, hingedly connected to the base, the lid comprising:

a top surface having a substantially circular recessed center portion projecting inwardly into the top surface, the substantially circular recessed center portion dimensioned to receive a substantially circular male protruding center portion of an identical container base stacked on top of the lid;

a pair of upper sidewalls; and a pair of upper end walls integrally connected to the top surface and the pair of upper sidewalls; and wherein an edge of the pair of upper sidewalls and the pair of upper end walls extend outwardly to form an upper rim.

20. The container of claim 19, wherein at least one longitudinal concave groove in the plurality of longitudinal concave grooves extends from the substantially circular male protruding center portion to at least partially up the continuous sidewall.

* * * * *

UNITED STATES PATENT AND TRADEMARK OFFICE

CERTIFICATE OF CORRECTION

PATENT NO. : 8,567,604 B2
APPLICATION NO. : 13/239851
DATED : October 29, 2013
INVENTOR(S) : Peter Overgaag It is certified that error appears in the above-identified patent and that said Letters Patent is hereby corrected as shown below:

On the Title Page, Item 75 under Inventor replace "Overgaad" with --Overgaag--.

Signed and Sealed this
Thirty-first Day of December, 2013

Margaret A. Focarino

Margaret A. Focarino
*Commissioner for Patents of the United States Patent and Trademark Office*